US007921508B2

(12) United States Patent
Ivarsson et al.

(10) Patent No.: US 7,921,508 B2
(45) Date of Patent: Apr. 12, 2011

(54) TWIN CYCLONE VACUUM CLEANER

(75) Inventors: Bengt Ivar Anders Ivarsson, Smethwick (GB); Glenn Matusz, Cuyahoga Falls, OH (US); Reuben Proud, Worcester (GB); Sergey V. Makarov, Solon, OH (US)

(73) Assignee: Royal Appliance Mfg. Co., Glenwillow, OH (US)

( * ) Notice: Subject to any disclaimer, the term of this patent is extended or adjusted under 35 U.S.C. 154(b) by 667 days.

(21) Appl. No.: 11/817,938

(22) PCT Filed: Mar. 16, 2006

(86) PCT No.: PCT/US2006/009848

§ 371 (c)(1),
(2), (4) Date: Sep. 6, 2007

(87) PCT Pub. No.: WO2006/102147

PCT Pub. Date: Sep. 28, 2006

(65) Prior Publication Data

US 2008/0184522 A1 Aug. 7, 2008

(51) Int. Cl.
*A47L 9/16* (2006.01)

(52) U.S. Cl. ..... 15/351; 15/352; 15/353

(58) Field of Classification Search ..... 15/351, 15/352, 353; 55/459.1, 459.3, DIG. 3; *A47L 9/16*
See application file for complete search history.

(56) References Cited

U.S. PATENT DOCUMENTS

| | | | | |
|---|---|---|---|---|
| 5,307,538 | A * | 5/1994 | Rench et al. | 15/352 |
| 7,273,506 | B2 * | 9/2007 | Oh et al. | 55/343 |
| 2006/0277712 | A1 * | 12/2006 | Kim et al. | 15/353 |

FOREIGN PATENT DOCUMENTS

| | | | |
|---|---|---|---|
| AU | 2004214561 | B2 | 11/2005 |
| AU | 2004226929 | B2 | 12/2005 |

* cited by examiner

*Primary Examiner* — David A Redding
(74) *Attorney, Agent, or Firm* — Michael Best & Friedrich LLP

(57) ABSTRACT

An upright vacuum cleaner (A) includes a housing (B) having a suction airstream inlet and a suction airstream outlet. A dirt container (50, 500) is selectively mounted to the housing for receiving and retaining dirt and dust separated from the suction airstream. The suction airstream inlet and the suction airstream outlet are in fluid communication with, respectively, an inlet and an outlet of the dirt container. The dirt container includes a first cyclonic air-flow chamber (66, 508) and a second cyclonic airflow chamber (68, 510), each cyclonic airflow chamber including a longitudinal axis. The second cyclonic airflow chamber is spaced from the first chamber, wherein the first and second chambers are each approximately vertically oriented and are arranged in a parallel relationship. An air manifold (52, 540, 540') is disposed at a top portion of the dirt container. The air manifold includes an inlet section (54, 536, 565) through which dirty air passes and an outlet section (138, 560, 560'). The inlet section directs a flow of dirty air into two separate inlet conduits leading to a respective one of the first and second airflow chambers. The outlet section collects a flow of cleaned air from both of the chambers and merges the flow of cleaned air into a single outlet conduit (110, 570). An airstream suction source (E) is mounted to the housing and is in communication with the outlet conduit of the manifold.

5 Claims, 20 Drawing Sheets

TWIN CYCLONE VACUUM CLEANER

BACKGROUND OF THE INVENTION

The present invention relates to vacuum cleaners. More particularly, the present invention relates to upright vacuum cleaners used for suctioning dirt and debris from carpets and floors.

Upright vacuum cleaners are well known in the art. The two major types of traditional vacuum cleaners are a soft bag vacuum cleaner and a hard shell vacuum cleaner. In the hard shell vacuum cleaner, a vacuum source generates the suction required to pull dirt from the carpet or floor being vacuumed through a suction opening and into a filter bag or a dust cup housed within the hard shell upper portion of the vacuum cleaner. After multiple uses of the vacuum cleaner, the filter bag must be replaced or the dust cup emptied.

To avoid the need for vacuum filter bags, and the associated expense and inconvenience of replacing the filter bag, another type of upright vacuum cleaner utilizes cyclonic air flow and one or more filters, rather than a replaceable filter bag, to separate the dirt and other particulates from the suction air stream. Such filters need infrequent replacement.

While some prior art cyclonic air flow vacuum cleaner designs and constructions are satisfactory, it is desirable to develop continued improvements and alternative designs for such vacuum cleaners. For example, it would be desirable to simplify assembly and improve filtering and dirt removal.

Accordingly, the present invention provides a new and improved upright vacuum cleaner having a twin cyclonic airflow design which overcomes difficulties with the prior art while providing better and more advantageous overall results.

BRIEF DESCRIPTION OF THE INVENTION

In one embodiment of the present invention, a twin cyclone vacuum cleaner is provided.

More particularly, in accordance with this aspect of the present invention, a vacuum cleaner comprises a housing including a suction airstream inlet and a suction airstream outlet. A dirt container is selectively mounted to the housing for receiving and retaining dirt and dust separated from the suction airstream. The suction airstream inlet and the suction airstream outlet are in fluid communication with, respectively, an inlet and an outlet of the dirt container. The dirt container includes a first cyclonic airflow chamber and a second cyclonic airflow chamber, each cyclonic airflow chamber including a longitudinal axis. The second cyclonic airflow chamber is spaced from the first chamber, wherein the first and second chambers are each approximately vertically oriented and are arranged in a parallel relationship. An air manifold is disposed at a top portion of the dirt container. The air manifold includes an inlet section through which dirty air passes and an outlet section. The inlet section directs a flow of dirty air into two separate inlet conduits leading to a respective one of the first and second airflow chambers. The outlet section collects a flow of cleaned air from both of the chambers and merges the flow of cleaned air into a single outlet conduit. An airstream suction source is mounted to the housing and is in communication with the outlet conduit of the manifold.

In accordance with another aspect of the present invention, a vacuum cleaner includes a housing, a nozzle base having a main suction opening, an airstream suction source, an air manifold and a dirt cup. The housing is pivotally mounted on the nozzle base. The airstream suction source is mounted to one of the housing and the nozzle base for selectively establishing and maintaining a suction airstream from the nozzle main suction opening to an exhaust outlet of the suction source. The dirt cup is selectively mounted to the housing. The dirt cup comprises a first centrifugal chamber having a first longitudinal axis. The first centrifugal chamber includes a first cyclone assembly for removing at least some contaminants from the airstream. A first perforated tube extends in the first cyclonic chamber and includes a closed lower end and an open upper end in fluid communication with the air manifold. A skirt extends away from the closed lower end of the perforated tube. A laminar flow member extends away from the closed lower end of the perforated tube. At least a portion of the laminar flow member is encircled by said skirt.

In accordance with yet another aspect of the present invention, x vacuum cleaner includes a housing and a dirt container selectively mounted to the housing. The dirt container includes a side wall and a separator cone mounted to the side wall. A perforated tube extends longitudinally is the separator cone. A cyclonic flow chamber is defined between the separator cone and the perforated tube. A dirt storage area is located beneath the separator cone. An air manifold comprises a top wall of the dirt container. The separator cone and the perforated tube communicates with the air manifold.

In accordance with still yet another aspect of the present invention, each perforated tube further includes an axially extending laminar flow member, wherein the air discharged through a pair of dirty air outlets communicating with a respective one of first and second centrifugal chambers loses its rotative force by the laminar flow member.

In accordance with still yet another aspect of the present invention, the air manifold includes an inlet section which directs a flow of the dirty airstream into two separate dirty air outlets leading to a respective one of the first and second airflow chambers. The inlet section is inclined at an acute angle which allows the airstream within the inlet section to be drawn into the airflow chambers by way of the venturi effect thereby increasing the velocity of the airstream entering the airflow chambers.

Still other aspects of the invention will become apparent from a reading and understanding of the detailed description of the several embodiments hereinbelow.

BRIEF DESCRIPTION OF THE DRAWINGS

The present invention may take physical form in certain parts and arrangements of parts, several embodiments of which will be described in detail in this specification and illustrated in the accompanying drawings which form a part of the invention.

DETAILED DESCRIPTION OF THE PREFERRED EMBODIMENTS

Figure 1:
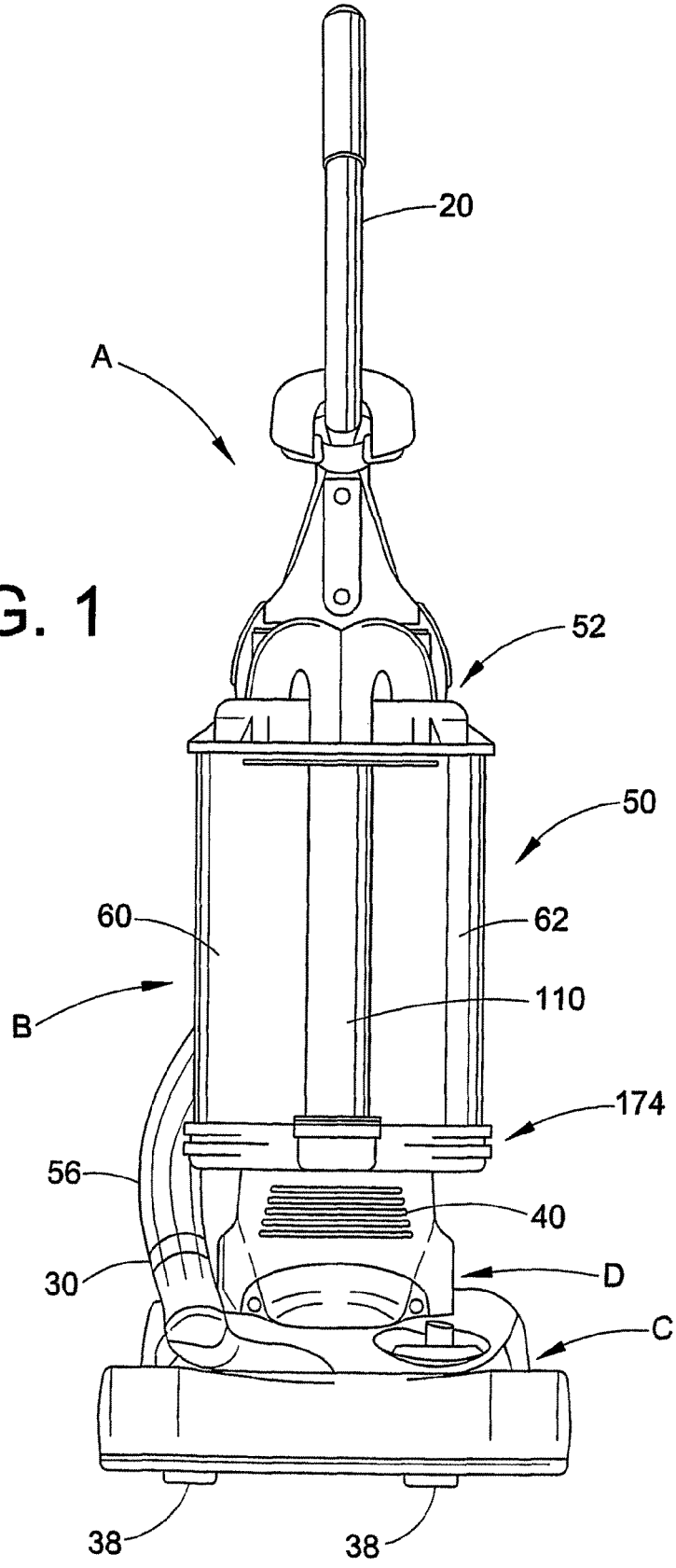
FIG. 1 is a front elevational view illustrating a cyclonic air flow vacuum cleaner including a dirt cup in accordance with a first embodiment of the present invention.

Referring now to the drawings, wherein the drawings illustrate the preferred embodiments of the present invention only and are not intended to limit same, FIG. 1 shows an upright vacuum cleaner A including an upright housing section B and a nozzle base section C. The sections B and C are pivotally or hingedly connected through the use of trunnions or another suitable hinge assembly D so that the upright housing section B pivots between a generally vertical storage position (as shown) and an inclined use position. Both the upright and nozzle sections B and C can be made from conventional materials, such as molded plastics and the like. The upright section B includes a handle 20 extending upward therefrom, by which an operator of the vacuum cleaner A is able to grasp and maneuver the vacuum cleaner.

Figure 2:
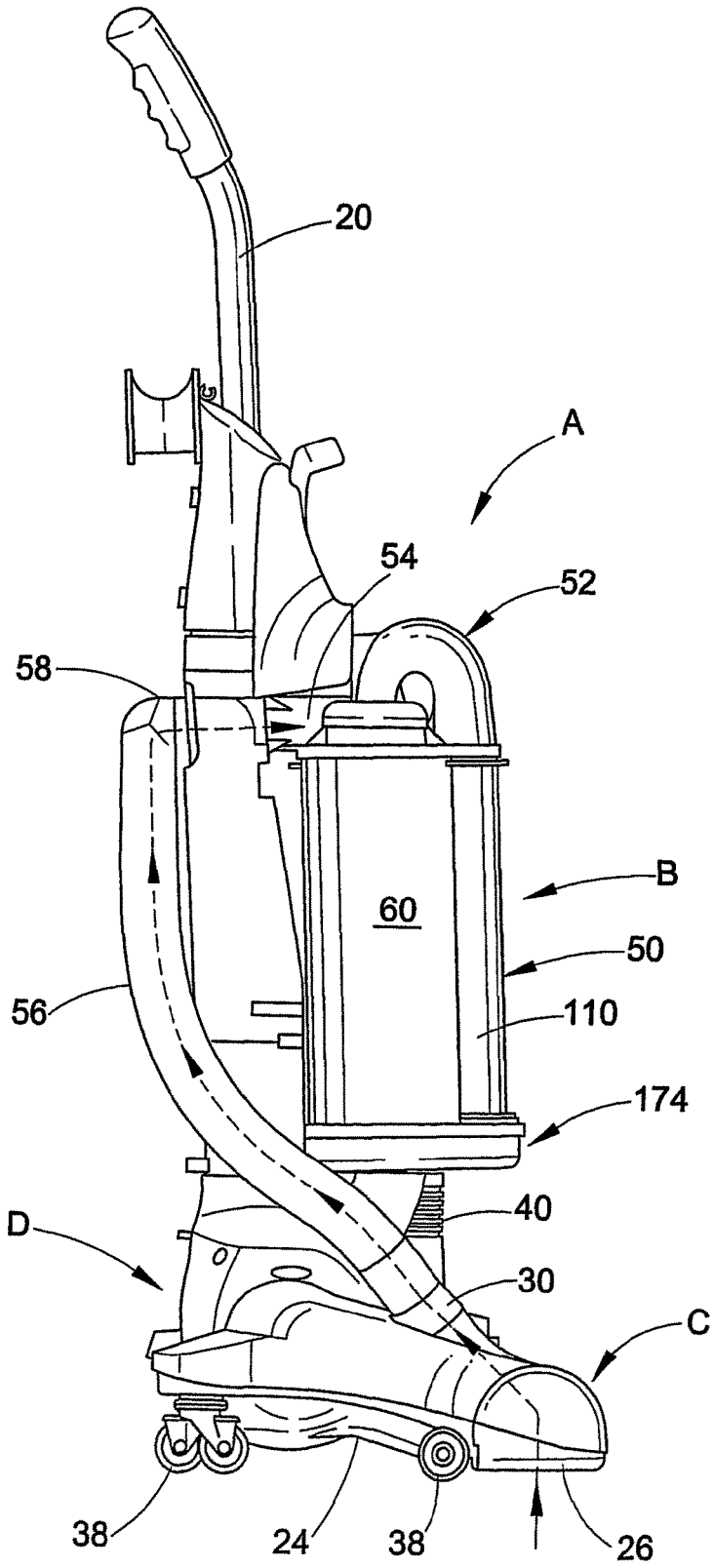
FIG. 2 is a left side elevational view of the cyclonic air flow vacuum cleaner of FIG. 1.
Figure 3:
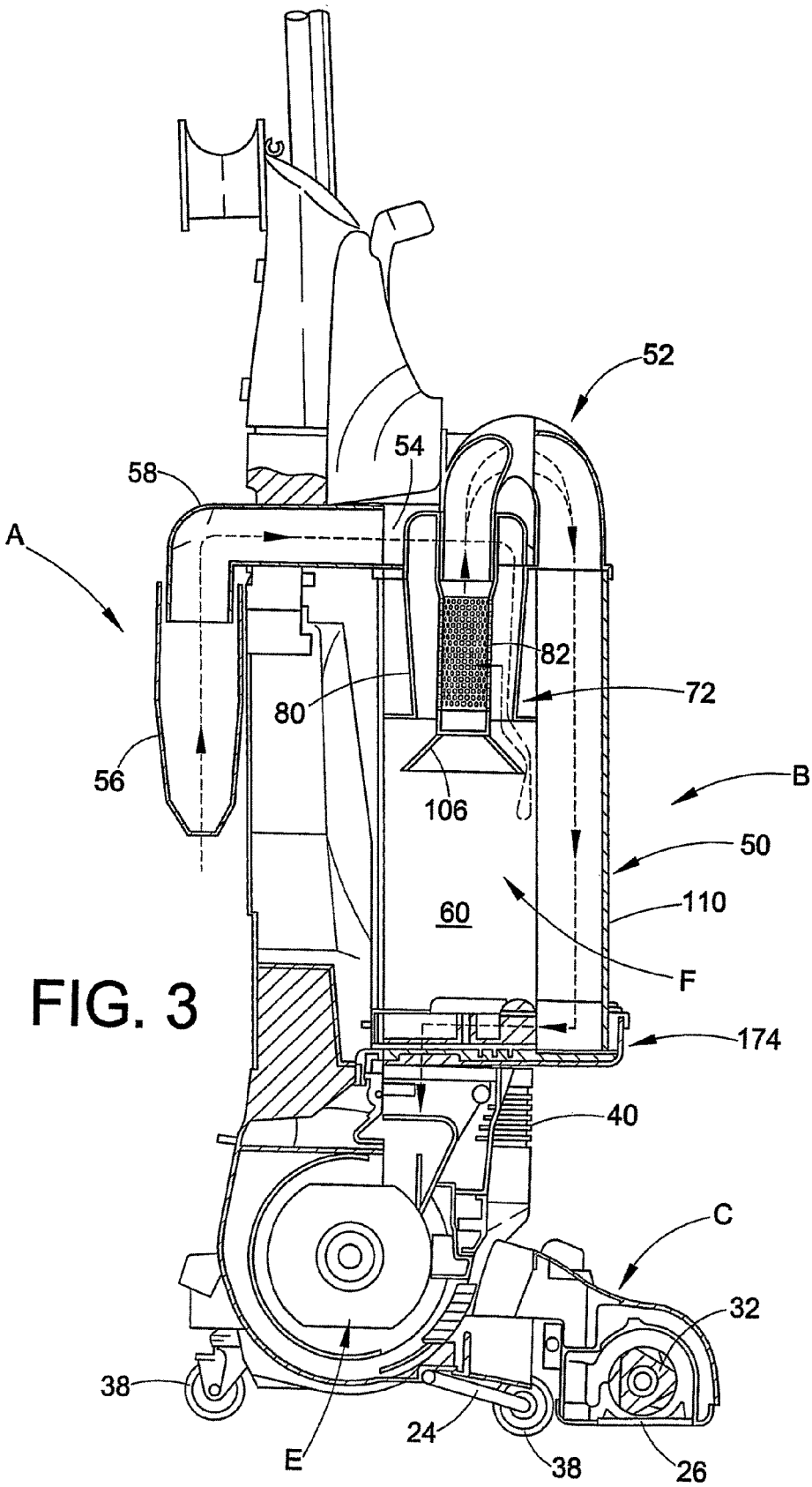
FIG. 3 is an enlarged left side elevational view in cross section, and partially broken away, of the cyclonic air flow vacuum cleaner of FIG. 1.

During vacuuming operations, the nozzle base C travels across a floor, carpet, or other subjacent surface being cleaned. With reference now to FIGS. 2 and 3, an underside 24 of the nozzle base includes a main suction opening 26 formed therein, which can extend substantially across the width of the nozzle at the front end thereof. As is known, the main suction opening 26 is in fluid communication with the vacuum upright body section B through a passage and a connector hose assembly, such as at 30. A rotating brush assembly 32 is positioned in the region of the nozzle main suction opening 26 for contacting and scrubbing the surface being vacuumed to loosen embedded dirt and dust. A plurality of wheels 38 supports the nozzle on the surface being cleaned and facilitates its movement thereacross.

The upright vacuum cleaner A includes a vacuum or suction source for generating the required suction airflow for cleaning operations. A suitable suction source, such as an electric motor and fan assembly E, generates a suction force in a suction inlet and an exhaust force in an exhaust outlet. The motor assembly airflow exhaust outlet is in fluid communication with an exhaust grill 40. If desired, a final filter assembly can be provided for filtering the exhaust airstream of any contaminants which may have been picked up in the motor assembly immediately prior to its discharge into the atmosphere. The motor assembly suction inlet, on the other hand, is in fluid communication with a dust and dirt separating region F (FIG. 3) of the vacuum cleaner A to generate a suction force therein.

The dust and dirt separating region F housed in the upright section B includes a dirt cup or container 50 which is releasably connected to the upper housing B of the vacuum cleaner. Cyclonic action in the dust and dirt separating region F removes a substantial portion of the entrained dust and dirt from the suction airstream and causes the dust and dirt to be deposited in the dirt container 50. The suction airstream enters an air manifold 52 of the dirt container through a suction airstream inlet section 54 which is formed in the air manifold. The suction airstream inlet 54 is in fluid communication with a suction airstream hose 56 through a fitting 58 as illustrated in FIGS. 2 and 3. The dirt container 50 can be mounted to the vacuum cleaner upright section B via conventional means.

Figure 4:
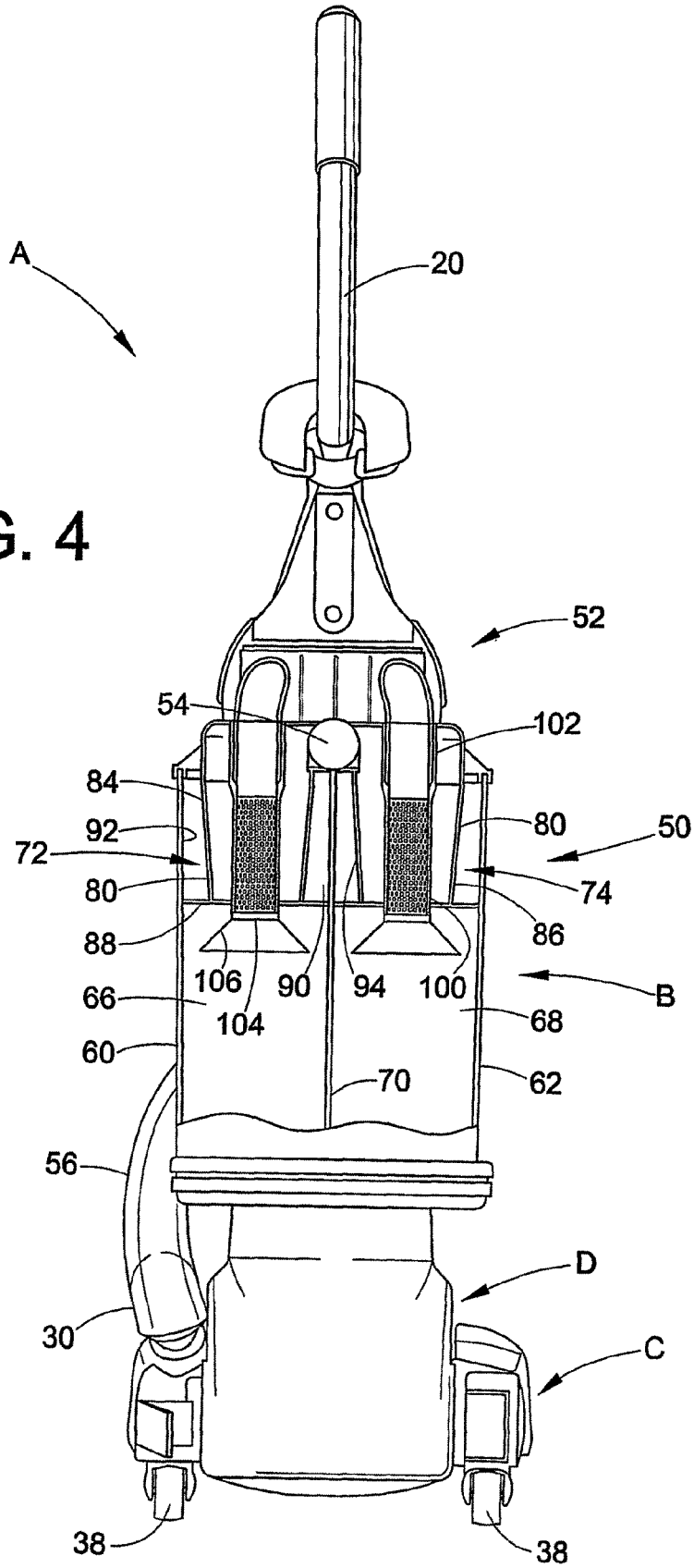
FIG. 4 is a rear elevational view in cross section, and partially broken away, of the cyclonic air flow vacuum cleaner including of FIG. 1.

As shown in FIG. 4, the dirt container 50 includes first and second generally cylindrical sections 60 and 62. Each cylindrical sections includes a longitudinal axis, the longitudinal axis of the first cylindrical section is spaced from the longitudinal axis of the second cylindrical section. The first and second cylindrical sections define a first cyclonic airflow chamber 66 and a second cyclonic airflow chamber 68, respectively. The first and second airflow chambers are each approximately vertically oriented and are arranged in a parallel relationship. The cylindrical sections 60, 62 have a common outer wall and are separated from each other by a dividing wall 70.

The first and second cyclonic airflow chambers include respective first and second cyclone assemblies 72 and 74. The first and second cyclone assemblies act simultaneously to remove coarse dust from the airstream. Each cyclone assembly includes a separator cone 80 and a perforated tube 82 disposed within the separator cone. The separator cones have a larger diameter end 84 located adjacent a top portion of the dirt container 50 and a smaller diameter end 86 spaced from the top portion. A flange 88 extends radially from the smaller diameter end 84. As best illustrated in FIG. 4, the flange is dimensioned to effectively seal off a space 90, which is defined by an inner surface 92 of each cylindrical section 60, 62, the dividing wall 70 and an outer periphery 94 of the separator cone 80, from the dirt entrained airstream entering into the first and second cyclonic airflow chambers 66, 68.

Each perforated tube 82 extends longitudinally in its respective cyclonic airflow chamber 66 and 68. In the present embodiment, the tubes have longitudinal axes coincident with the longitudinal axes of the first and second cylindrical sections 60, 62; although, it should be appreciated that the respective axes can be spaced from each other. Each perforated tube 82 includes a plurality of small holes 100 disposed in a side wall of the tube for removing threads and fibers from the airstream. The diameter of the holes 100 and the number of those holes within the perforated tube 82 directly affect the filtration process occurring within each cyclonic airflow chambers 66, 68. Also, additional holes result in a larger total opening area and thus the airflow rate through each hole is reduced. Thus, there is a smaller pressure drop and lighter dust and dirt particles will not be as likely to block the holes.

Each perforated tube further includes an upper end 102 in fluid communication with the inlet section 54 of the air manifold 52 and a closed lower end 104. The closed lower end of each tube 82 includes an outwardly flared portion 106 for retarding an upward flow of dust that has fallen below the lower end 104.

With continued reference to FIGS. 3 and 4, the air manifold 52 is disposed at a top portion of the dirt container 50. The air manifold directs dirty air to each of the first and second cyclonic flow chambers 66, 68 and directs a flow of cleaned air from each of the first and second cyclonic flow chambers to the electric motor and fan assembly E of the vacuum cleaner A. The features of the air manifold and the securing of the air manifold to the dirt container 50 will be discussed in greater detail below with reference to a second embodiment of the vacuum cleaner A.

The air manifold 52 collects a flow of cleaned air from both of the airflow chambers and merges the flow of cleaned air into a single cleaned air outlet passage or conduit 110 which is in fluid communication with an inlet (not shown) of the electric motor and fan assembly E. With continued reference to FIG. 3, the outlet passage 110 has a longitudinal axis which is oriented approximately parallel to the longitudinal axes of the first and second cyclonic chambers 66, 68. The features of the outlet passage and the securing of the outlet passage to the air manifold 52 will also be discussed in greater detail below with reference to a second embodiment of the vacuum cleaner A.

Figure 5:
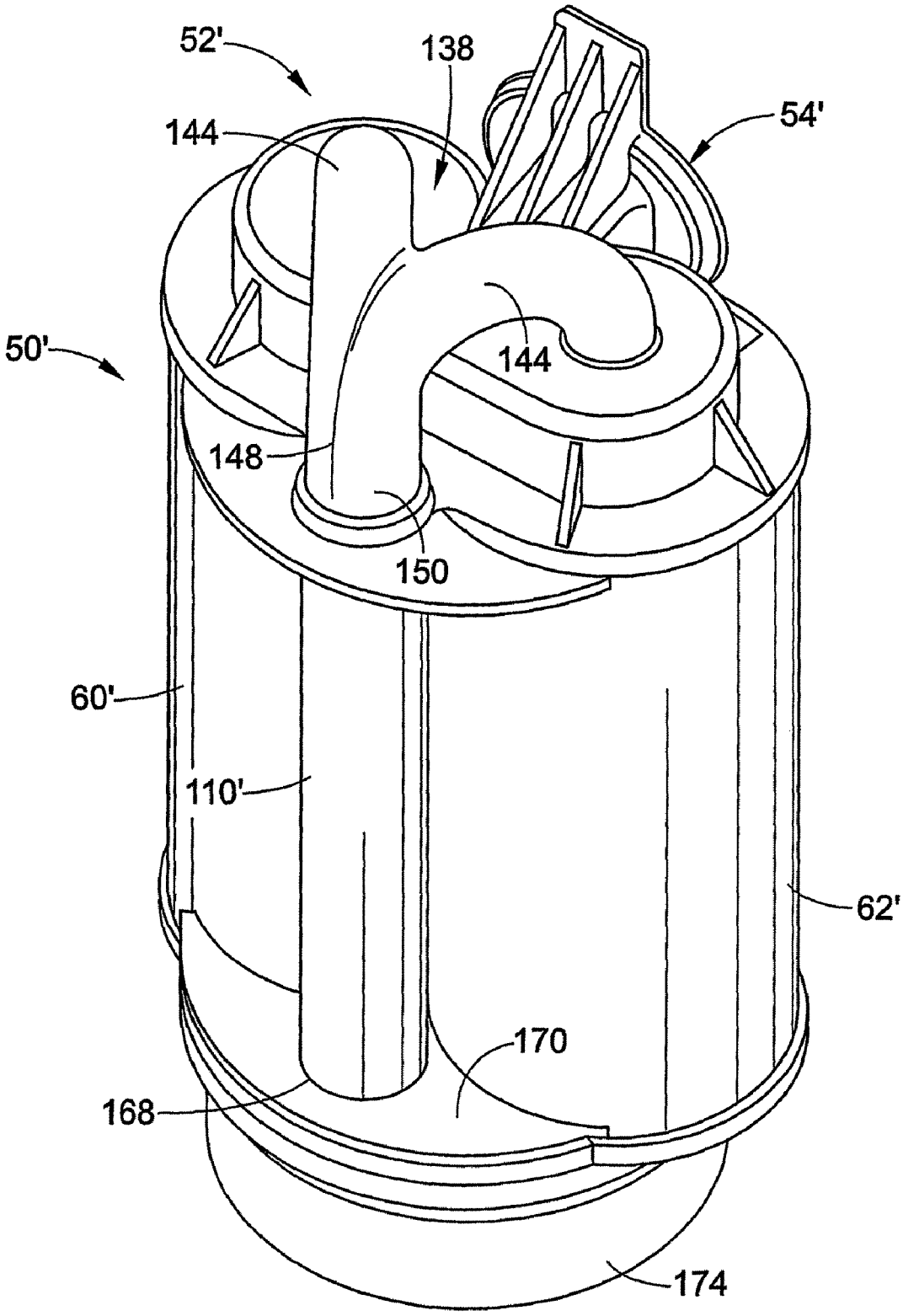
FIG. 5 is an enlarged front perspective view of an assembled dirt cup for the cyclonic air flow vacuum cleaner of FIG. 1 in accordance with a second embodiment of the present invention.
Figure 6:
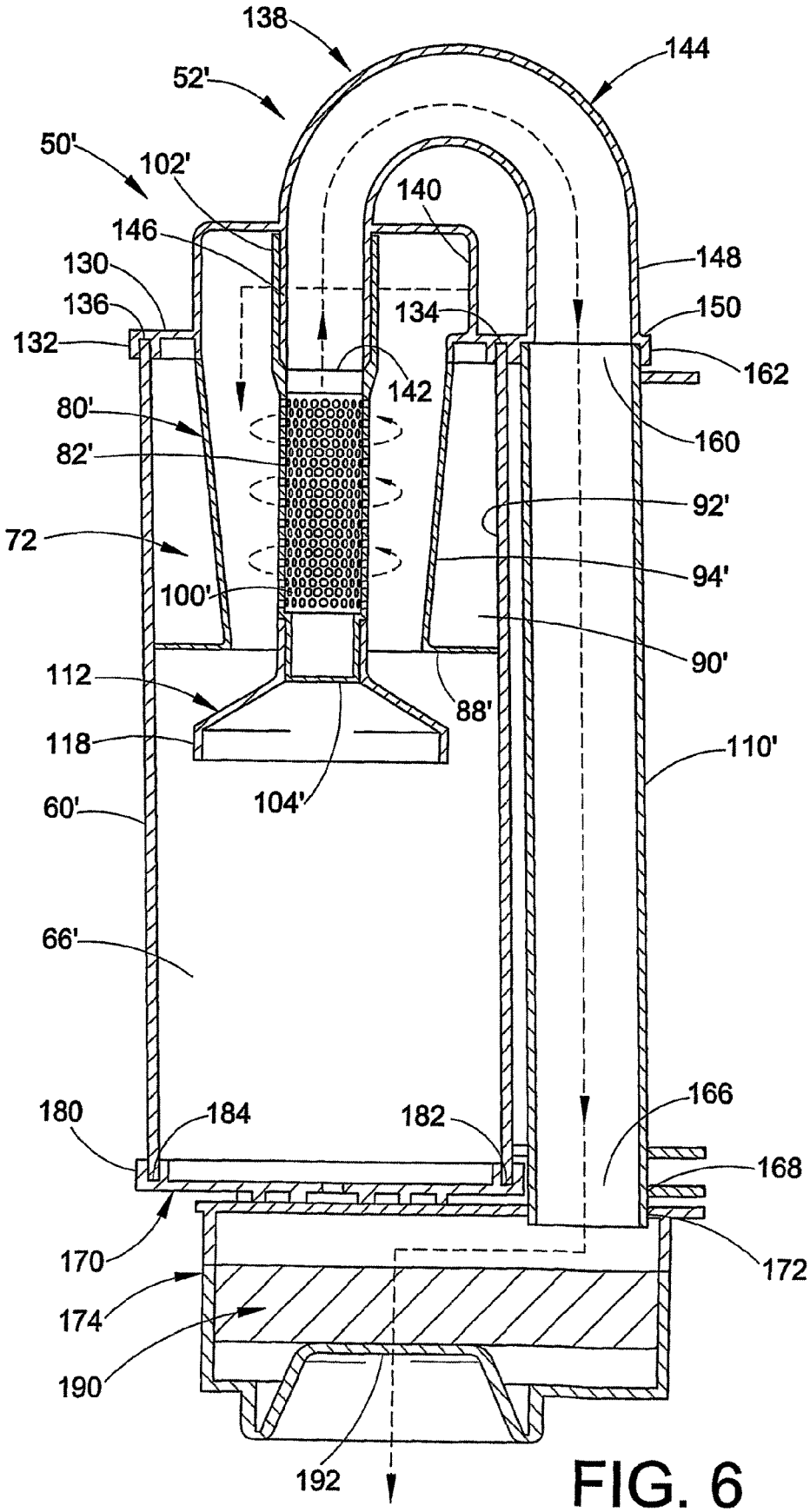
FIG. 6 is a side cross-sectional view of the dirt cup of FIG. 5 and a portion of a base on which it rests.
Figure 7:
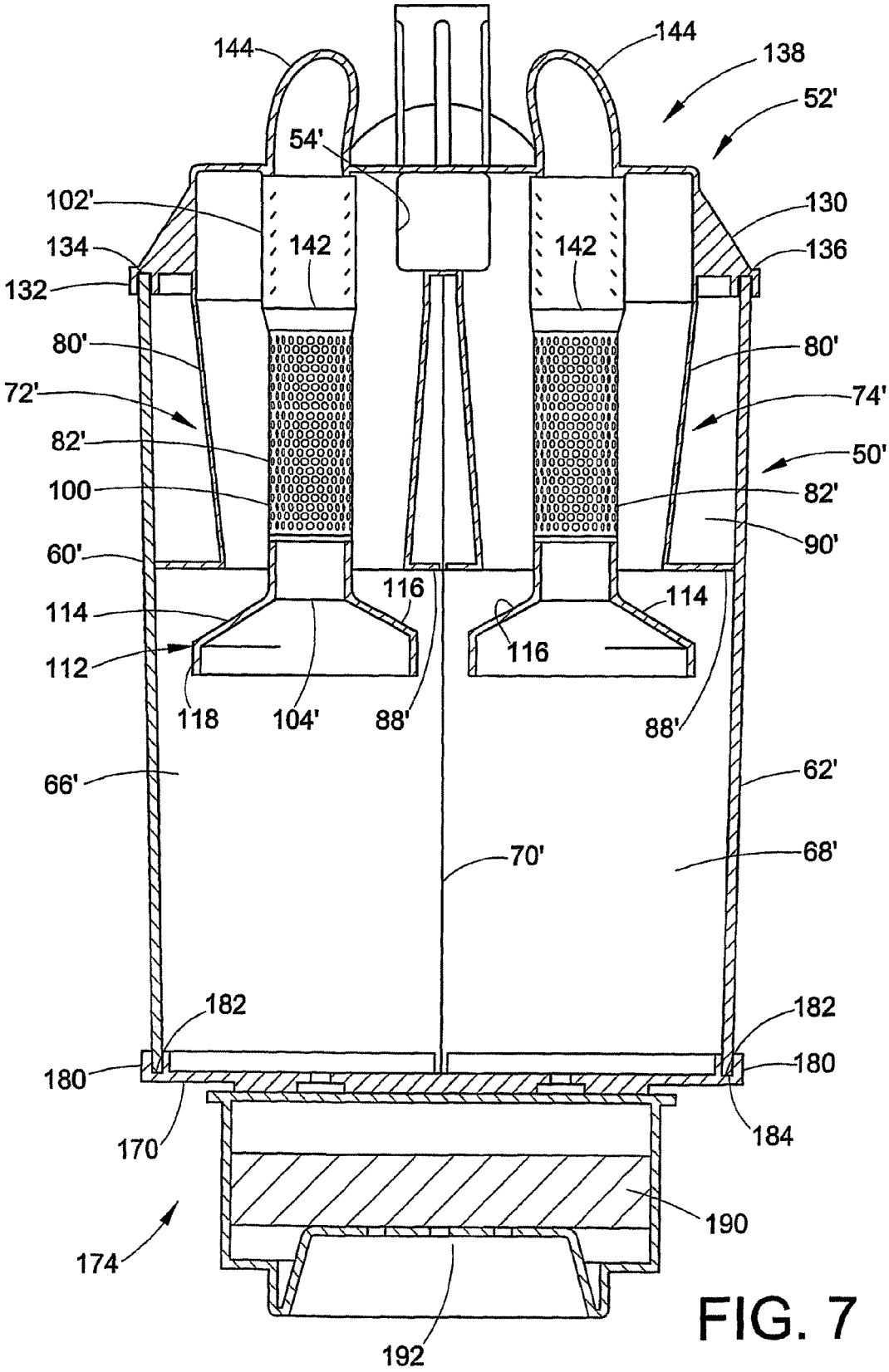
FIG. 7 is a front cross-sectional view of the dirt cup of FIG. 5.

Similar to the aforementioned embodiment, a second embodiment is shown in FIGS. 5-7. Since most of the structure and function is substantially identical, reference numerals with a single primed suffix (') refer to like components (e.g., dirt container is referred to by reference numeral 50'), and new numerals identify new components in the additional embodiment.

With reference to FIGS. 6 and 7, the dirt container 50' includes first and second generally cylindrical sections 60' and 62'. The first and second cylindrical sections include a first cyclonic airflow chamber 66' and a second cyclonic airflow chamber 68', respectively, each cyclonic airflow chamber including a longitudinal axis. The cylindrical sections 60', 62' have a common outer wall and are separated from each other by a dividing wall 70'.

The first and second cyclonic airflow chambers include respective first and second cyclone assemblies 72' and 74'. Each cyclone assembly includes a separator cone 80' and a perforated tube 82' disposed within the separator cone. The separator cones have a larger diameter end 84' located adjacent a top portion of the dirt container 50' and a smaller diameter end 86' spaced from the top portion. A flange 88' extends radially from the smaller diameter end 84'.

Each perforated tube 82' extends longitudinally in each cyclonic airflow chambers 66', 68' and includes a plurality of small holes 100' disposed in a side wall of the tube. Each perforated tube further includes an upper end 102' in fluid communication with the inlet section 54' of the air manifold 52' and a closed lower end 104'. As shown in FIGS. 6 and 7, the closed lower end of each tube 82 includes an outwardly flared section 112 which also retards an upward flow of dust that has fallen below the lower end 104'. The flared section includes a first portion 114 and a second portion 116, the first portion being larger than the second portion. A flange 118 extends longitudinally from the flared section which also blocks rising dust from reentering the separator cone, thereby further improving the filtering of the dust entrained airstream.

With continued reference to FIGS. 6 and 7, to secure the air manifold to the dirt container 50, a lower portion 130 of the air manifold includes downwardly extending flanges 132 which define a recess 134. The recess is dimensioned to receive at least an upper peripheral end 136 of each cylindrical section 60' and 62', thereby creating a seal between the air manifold and the dirt container.

The air manifold includes the inlet section 54' through which dirty air passes and an outlet section 138. The inlet section, which is in fluid communication with the nozzle main suction opening 26, directs a flow of the dirty airstream into two separate dirty air outlets 140 leading to a respective one of the first and second airflow chambers 66', 68'. As is evident from FIGS. 6 and 7, an in-line flow path is thus provided from the air manifold inlet section 54' through the motor and fan assembly. More specifically, dirty air flows into the inlet section 54', into the two separate dirty air outlets 140 and thus into the first and second airflow chambers 66', 68' defined within the dirt container 50'. As illustrated by the arrows in FIGS. 6 and 7, the airflow into the airflow chambers 66', 68' is tangential. This causes a vortex-type, cyclonic or swirling flow as is illustrated by the arrows. Such vortex flow is directed downwardly in the airflow chamber since the top end thereof is blocked by the flange 88' of the separator cone 80'.

The outlet section 138 collects a flow of cleaned air from both of the airflow chambers and merges the flow of cleaned air into the single cleaned air outlet passage 110' which is in fluid communication with the inlet of the electric motor and fan assembly E. After being filtered, the air flows into and through the suction motor and fan assembly as is illustrated by the arrows. After being exhausted from the motor and fan assembly E, the air flows through the grill 40.

The outlet section includes a pair of cleaned air inlets 142 communicating with a respective one of the first and second centrifugal chambers 66', 68'. Each inlet is in fluid communication with a pair of cleaned air conduits 144. As shown in FIG. 6, a first end 146 of each cleaned air conduit 144 is secured to the upper end 102' of each perforated tube 82'. In this embodiment, the upper end 102' has an inner diameter greater than an outer diameter of the cleaned air conduit first end 146 such that the first end 146 is frictionally received in the upper end 102'. However, it should be appreciated that the cleaned air conduit first end 146 can have an outer diameter larger than an inner diameter of the upper end 102' such that the upper end 102' is frictionally received in the first end 146.

With reference to FIGS. 5 and 7, each cleaned air conduit 144 has a second end 148 which merges into a single outlet end 150 that is in fluid communication with an inlet 144 of the outlet passage 110'.

The outlet passage 110' has a longitudinal axis which is oriented approximately parallel to the longitudinal axes of the first and second cyclonic chambers 66', 68'. With reference again to FIG. 6, the inlet end 160 of the outlet passage 110' is secured to the lower portion 130 of the air manifold 52' and the single outlet end 150 of the cleaned air outlet conduits 144 by one of the flanges 132 and a flange 162 extending from the outlet end 150. An outlet end 166 of the outlet passage 110' extends through an opening 168 located in a bottom wall 170 of the dirt container 50' and a corresponding opening 172 located in a filter plenum 174. Similar to the flanges 132 of the air manifold, the bottom includes flanges 180 which also define a recess 182 dimensioned to receive at least a lower peripheral end 184 of each cylindrical sections 60' and 62', thereby creating a seal between the bottom and the dirt container.

As shown in FIGS. 6 and 7, the filter plenum 174, which can be located beneath the dirt container 50', houses a filter 190 which is in fluid communication with the outlet end 166 of the outlet passage 110'. The filter is disposed downstream from the first and second cyclonic chambers 66', 68' for filtering fine dirt from the airstream. The plenum can be suitably secured to one of the upright housing section B and a nozzle base section C by conventional means. An outlet 192 of the filter plenum 174 is in fluid communication with the inlet of the electric motor and fan assembly E.

Figure 8:
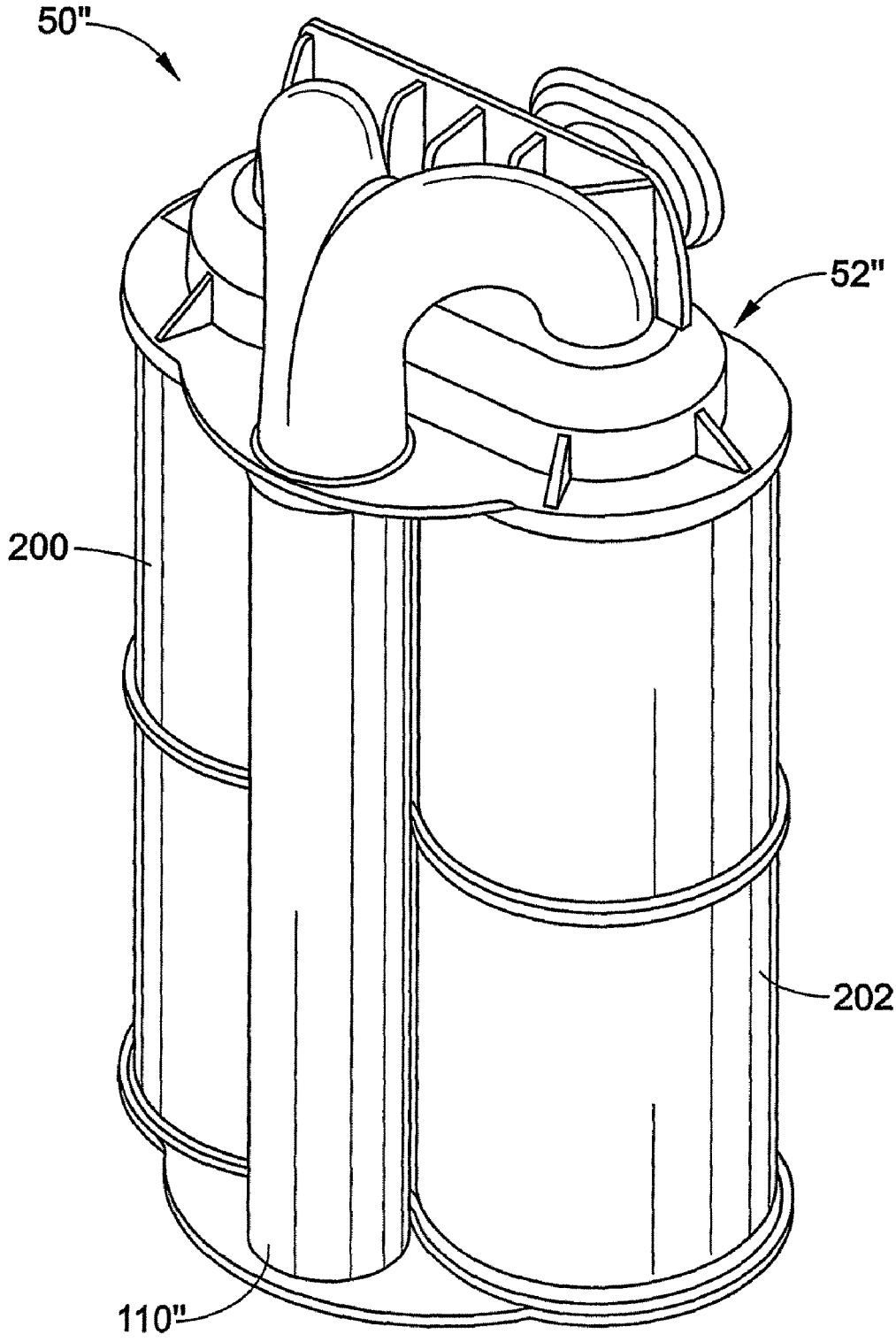
FIG. 8 is an assembled front perspective view of a dirt cup for the cyclonic airflow vacuum cleaner of FIG. 1 in accordance with a third embodiment of the present invention.
Figure 9:
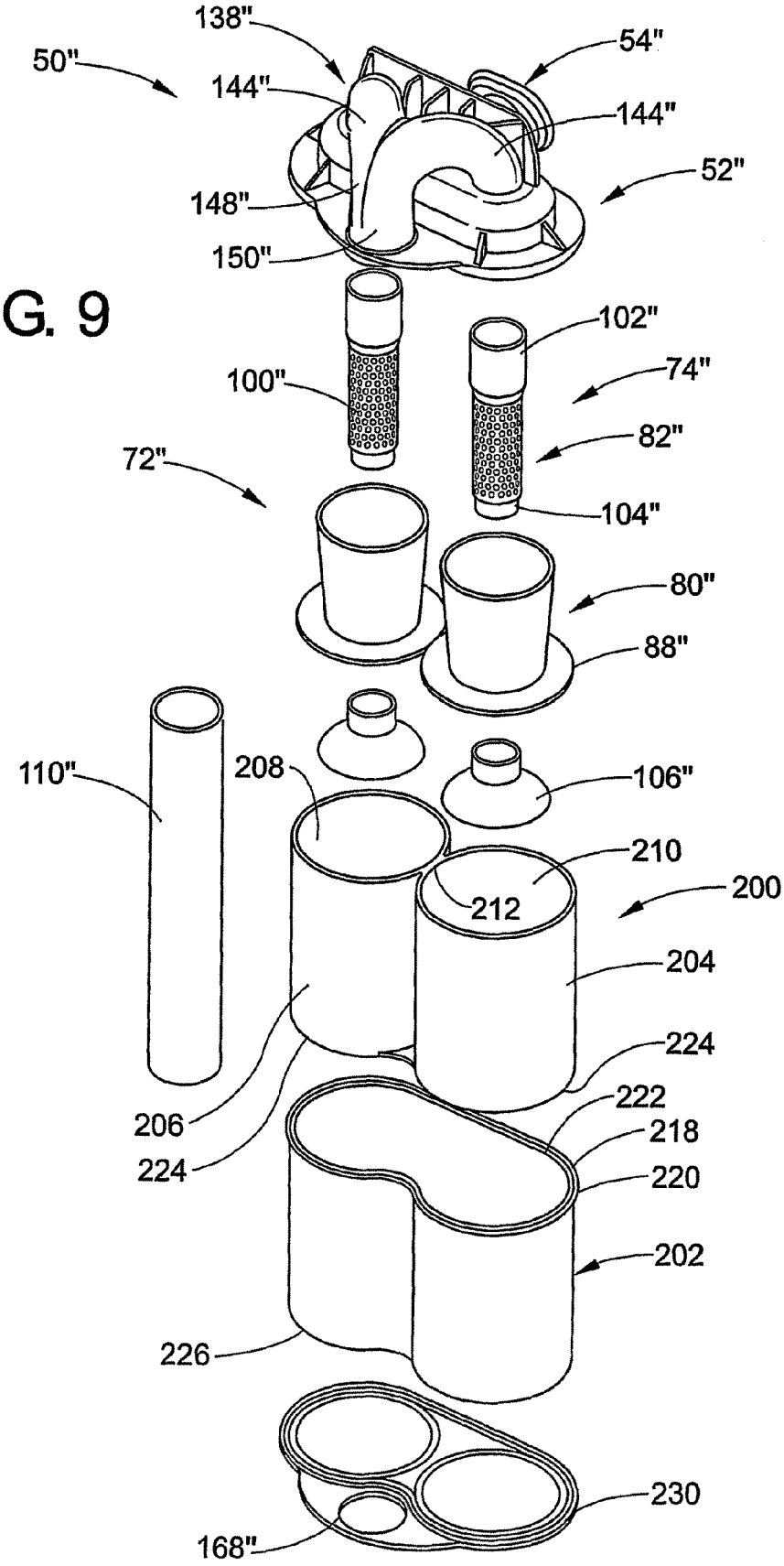
FIG. 9 is an exploded front perspective view of the dirt cup of FIG. 8.

Similar to the aforementioned embodiment, a third embodiment is shown in FIGS. 8 and 9. Since most of the structure and function is substantially identical, reference numerals with a double primed suffix (") refer to like components (e.g., dirt container is referred to by reference numeral 50"), and new numerals identify new components in the additional embodiment.

With reference to FIGS. 8 and 9, the dirt container 50" includes an upper portion 200 mounted to lower portion 202. The upper portion includes first and second generally cylindrical sections 204 and 206. The first and second cylindrical sections include a first cyclonic airflow chamber 208 and a second cyclonic airflow chamber 210, respectively. Each cyclonic airfow chamber includes a longitudinal axis. The longitudinal axis of the first cyclonic airfow chamber is spaced from the longitudinal axis of the second cyclonic airflow chamber and is oriented parallel thereto. The cylindrical sections 204, 206 are connected to each other by a common wall section 212. The first and second airflow chambers are each approximately vertically oriented and are arranged in a parallel relationship. The first and second cyclonic airflow chambers include the respective first and second cyclone assemblies 72" and 74".

Similar to the second embodiment, the air manifold 52" is secured to a top portion of the upper portion 200 of the dirt container 50". The air manifold directs dirty air to each of the first and second cyclonic flow chambers 208, 210. To secure the upper portion 200 to the lower portion 202, a top end 218 of the lower portion includes a lip 220 having a first section extending outwardly from the top end and a second section extending generally normal to the first section. The lip defines a shelf 222 which is dimensioned to receive a lower end 224 of the upper portion 200. A bottom end 226 of the lower portion 202 is secured to a bottom wall 230 of the dirt container 50" in a manner similar to the above described second embodiment, particularly the securing of the cylindrical sections 60', 62' to the bottom 170 of the dirt container 50'.

Similar to the aforementioned embodiments, a fourth embodiment is shown in FIGS. 10-14. Since most of the structure and function is substantially identical, reference numerals with a triple primed suffix (''') refer to like components (e.g., dirt container is referred to by reference numeral 50'''), and new numerals identify new components in the additional embodiment.

With reference to FIGS. 10-14, the dirt container 50''' includes an air manifold 300 and first and second generally cylindrical sections 302 and 304. The first and second cylindrical sections include a first cyclonic airflow chamber 310 and a second cyclonic airflow chamber 312, respectively. The first and second airflow chambers are each approximately vertically oriented and are arranged in a parallel relationship. The cylindrical sections are connected to each other by a common wall section 314. First and second rim sections 316, 318 extend between a top portion 320 of the cylindrical sections.

Figure 11:
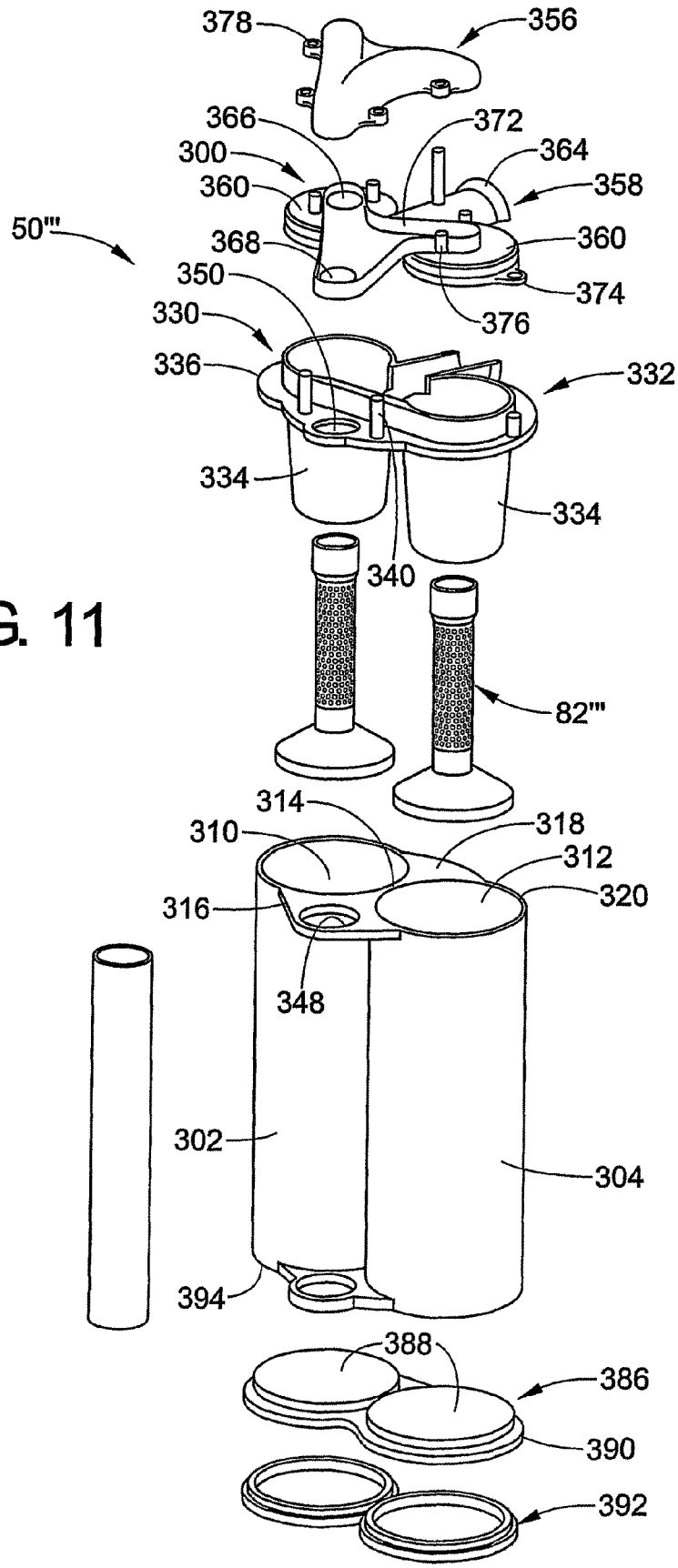
FIG. 11 is an exploded front perspective view of the dirt cup of FIG. 10.

As shown in FIG. 11, the first and second cyclonic airflow chambers include respective first and second cyclone assemblies 330 and 332. These cyclone assemblies act simultaneously to remove coarse dust from the airstream. Each cyclone assembly includes a separator cone 334 and a perforated tube 82''' disposed within the separator cone. A flange 336 extends continuously around a top portion of the separator cones 334. As best illustrated in FIG. 12, the flange is dimensioned to effectively seal the top portion 320 of the cylindrical sections 302 and 304.

Figure 12:
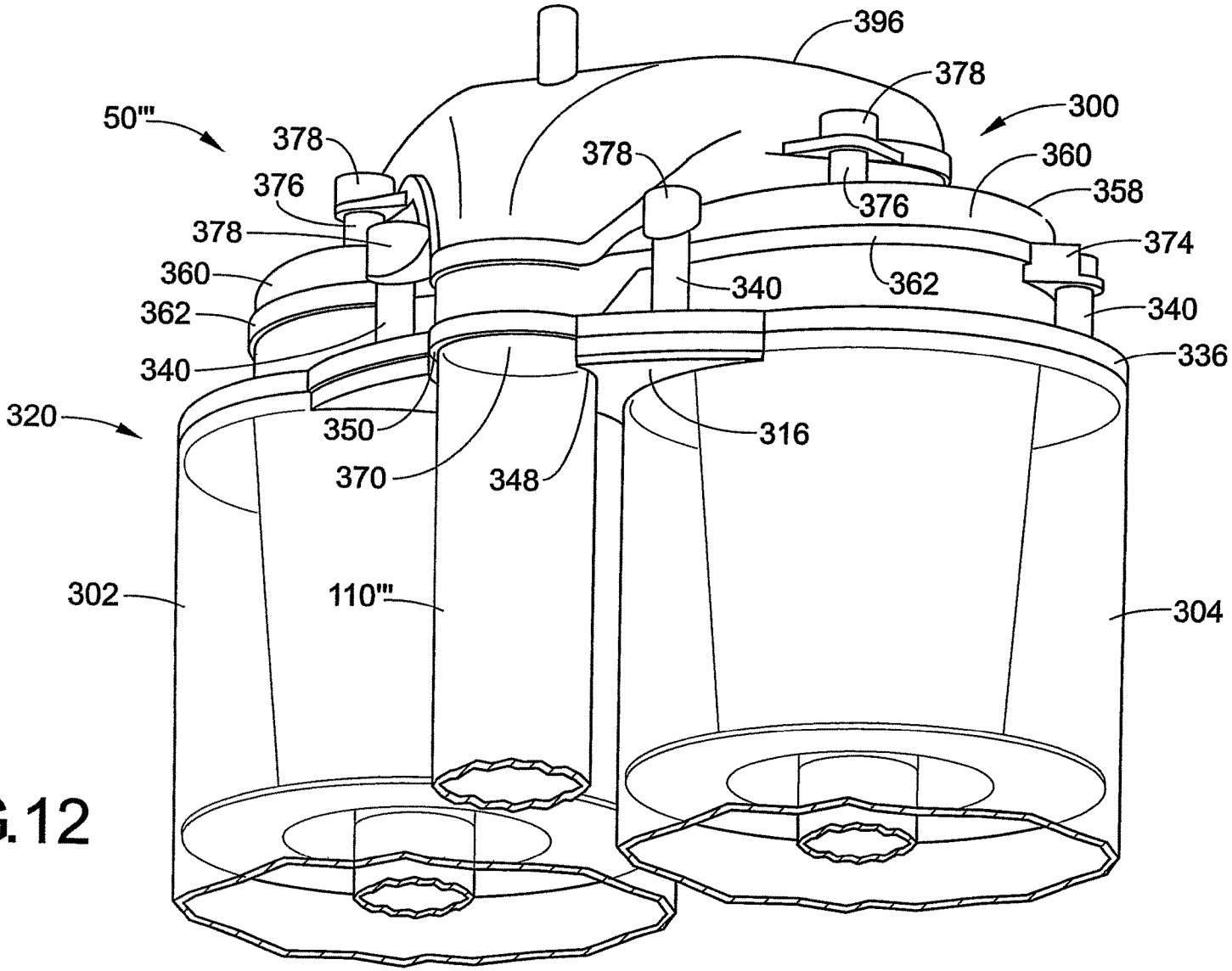
FIG. 12 is an enlarged front perspective view of an upper portion of the dirt cup of FIG. 10.

With continued reference to FIG. 12, extending from the flange 336 are a plurality of first projections 340, a first portion of the first projection extending upwardly from the flange and a second portion extending downwardly from the flange. The second portion of each first projection is received in an opening (not shown) located in the rim sections 316, 318. The flange 336 and rim section 316 further include mating openings 348, 350 dimensioned to receive the single cleaned air outlet passage 110'''.

Figure 13:
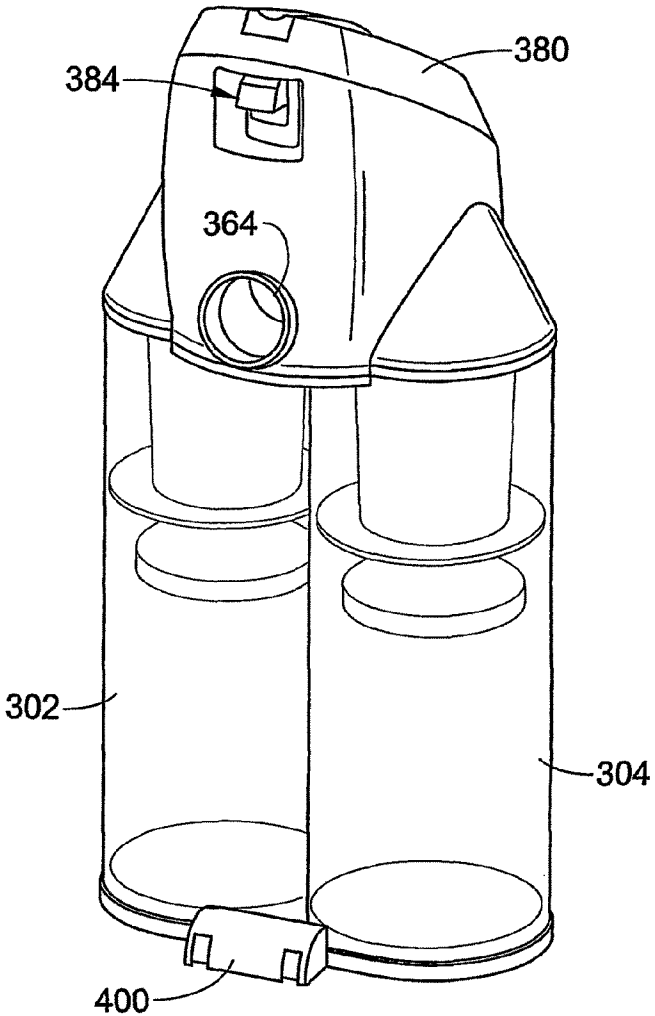
FIG. 13 is a rear perspective view of the dirt cup of FIG. 10.

With reference to FIG. 11, the air manifold 300 includes a top portion 356 and a bottom portion 358. The bottom portion includes a pair of cover plates 360 having a downwardly extending lip 362 which engages the top portion of the separator cones 334. As best shown in FIG. 13, an airstream inlet 364, which is in fluid communication with a nozzle main suction opening, extends outwardly from the bottom portion 358. Each cover plate includes an outlet 366 in fluid communication with an outlet 368 of the bottom portion 358 and a corresponding inlet 370 of the single cleaned air outlet passage 110'''. A vane 372 can direct the airstream from the outlets 366 to the inlet 370.

The bottom portion 358 further includes at least one tab 374. With reference now to FIG. 12, the tab includes an aperture (not shown) adapted to receive the upwardly extending first portion of at least one first projection 340. Similar to the flange 336, extending upwardly from the bottom portion is a plurality of second projections 376.

With continued reference to FIGS. 11 and 12, the top portion 356 includes a plurality of caps 378. The caps are adapted to receive the first and second projections 340, 374 thereby securing the top portion 356 of the air manifold to the bottom portion 358 of the air manifold and to the first and second generally cylindrical sections 302 and 304.

Figure 10:
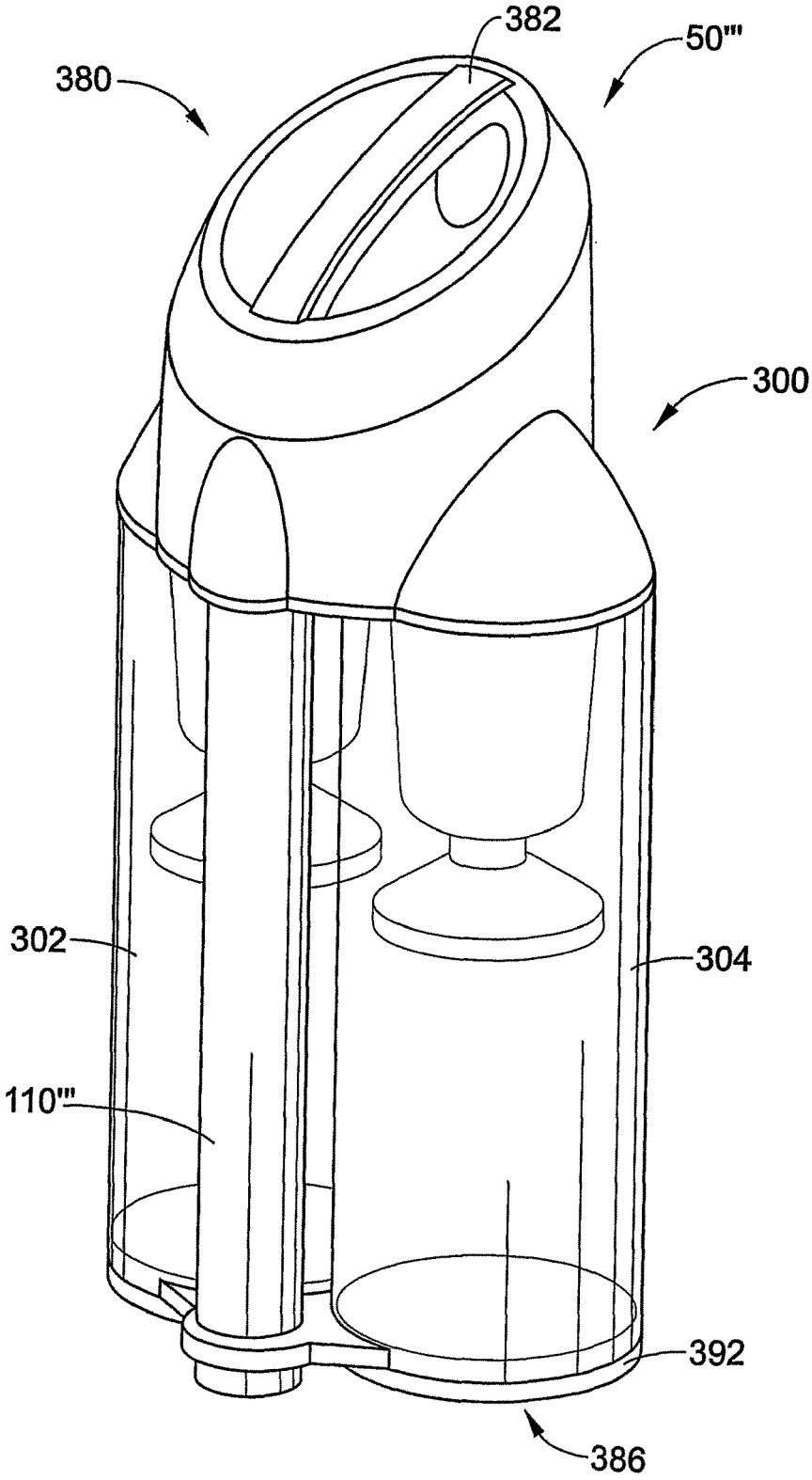
FIG. 10 is a front perspective view of a dirt cup for the cyclonic air flow vacuum cleaner of FIG. 1 in accordance with a fourth embodiment of the present invention.

With reference to FIG. 10, the dirt container 50''' includes a top wall 380 which is mounted to the air manifold 300. If desired, the top wall 380, including the air manifold 300 and the cyclone assemblies 330 and 332, could also be removable as a single unit from the top portion 320 of the cylindrical sections 302 and 304. Defined on the top wall is a handle 382 to facilitate operator movement of the dirt container. As shown in FIG. 13, a latch assembly 384, which is located on the top wall, cooperates with the upright housing section B to removably secure the dirt container 50''' to the upright housing section.

Figure 14:
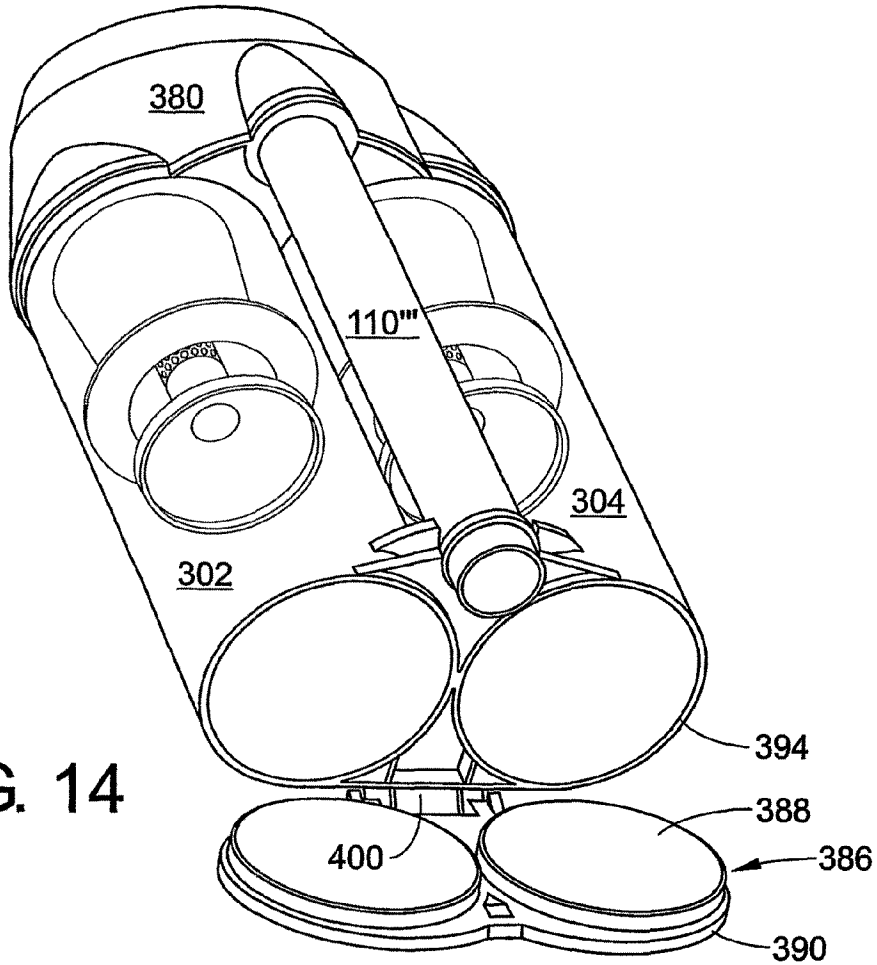
FIG. 14 is a front perspective view of the dirt cup of FIG. 10 with a bottom plate shown in an open position.

With reference to FIGS. 11 and 14, the dirt container 50''' further comprises a bottom plate or lid 386 including a pair of raised sections 388 and a continuous shelf 390. A pair of seal rings 392 can be fitted over the raised sections, a bottom portion of each seal ring sitting on the shelf 390. As shown in FIGS. 13 and 14, a hinge assembly 400 is used to mount the bottom plate to a bottom portion 394 of the first and second generally cylindrical sections 302 and 304. The hinge assembly allows the bottom plate 386 to be selectively opened so that dirt and dust particles that were separated from the airstream can be emptied from the dirt container.

Similar to the aforementioned embodiments, a fifth embodiment is shown in FIGS. 15-19.

Figure 15:
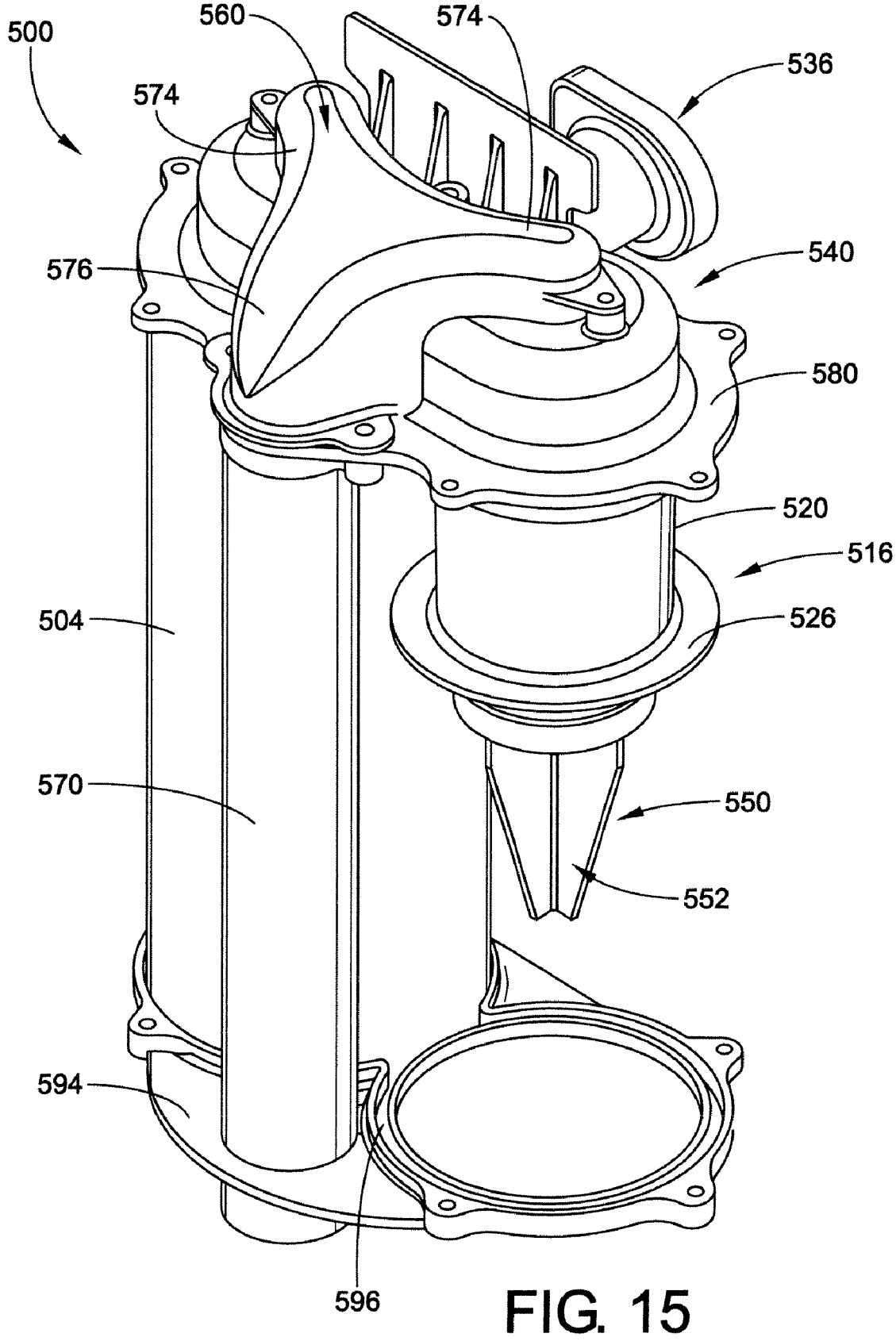
FIG. 15 is an enlarged front perspective view of a partially assembled dirt cup for the cyclonic air flow vacuum cleaner of FIG. 1 in accordance with a fifth embodiment of the present invention.
Figure 16:
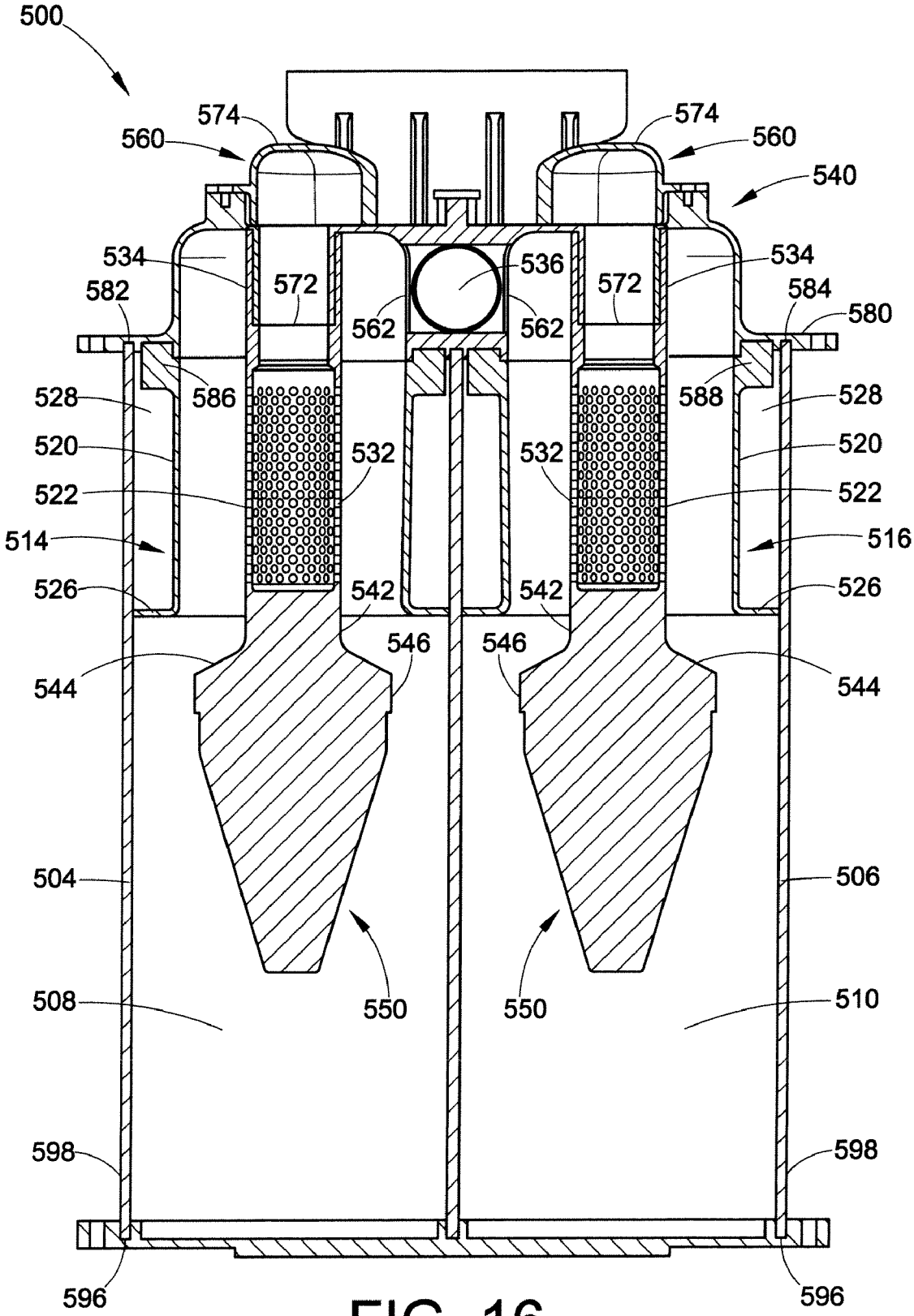
FIG. 16 is a front cross-sectional view of the dirt cup of FIG. 15.

With reference to FIGS. 15 and 16, a dirt container 500, which can be mounted to the vacuum cleaner upright section (not shown) via conventional means, includes first and second separate generally cylindrical sections 504 and 506. The first and second cylindrical sections include, respectively, a first cyclonic airflow chamber 508 and a second cyclonic airflow chamber 510. Each cyclonic airflow chamber includes a longitudinal axis. The longitudinal axis of the first cyclonic airflow chamber is spaced from the longitudinal axis of the second cyclonic airflow chamber and is oriented approximately parallel thereto. The first and second airflow chambers 508, 510 are each approximately vertically oriented and are arranged in a parallel relationship. Of course, other designs are also contemplated. For example, the first and second airflow chambers could be angled in relation to each other, if desired.

The first and second cyclonic airflow chambers include respective first and second cyclone assemblies 514 and 516. Each cyclone assembly includes a separator cone 520 and a perforated tube 522 disposed within the separator cone. The separator cones have a larger diameter end located adjacent a top portion of the dirt container 500 and a smaller diameter end spaced from the top portion. A flange 526 extends radially from the smaller diameter end. As best illustrated in FIG. 16, the flange is dimensioned to effectively seal off a space 528, which is defined by an inner surface of each cylindrical section 504, 506 and an outer periphery of the separator cone 520, from the dirt entrained airstream entering into the first and second cyclonic airflow chambers 508, 510.

Figure 17:
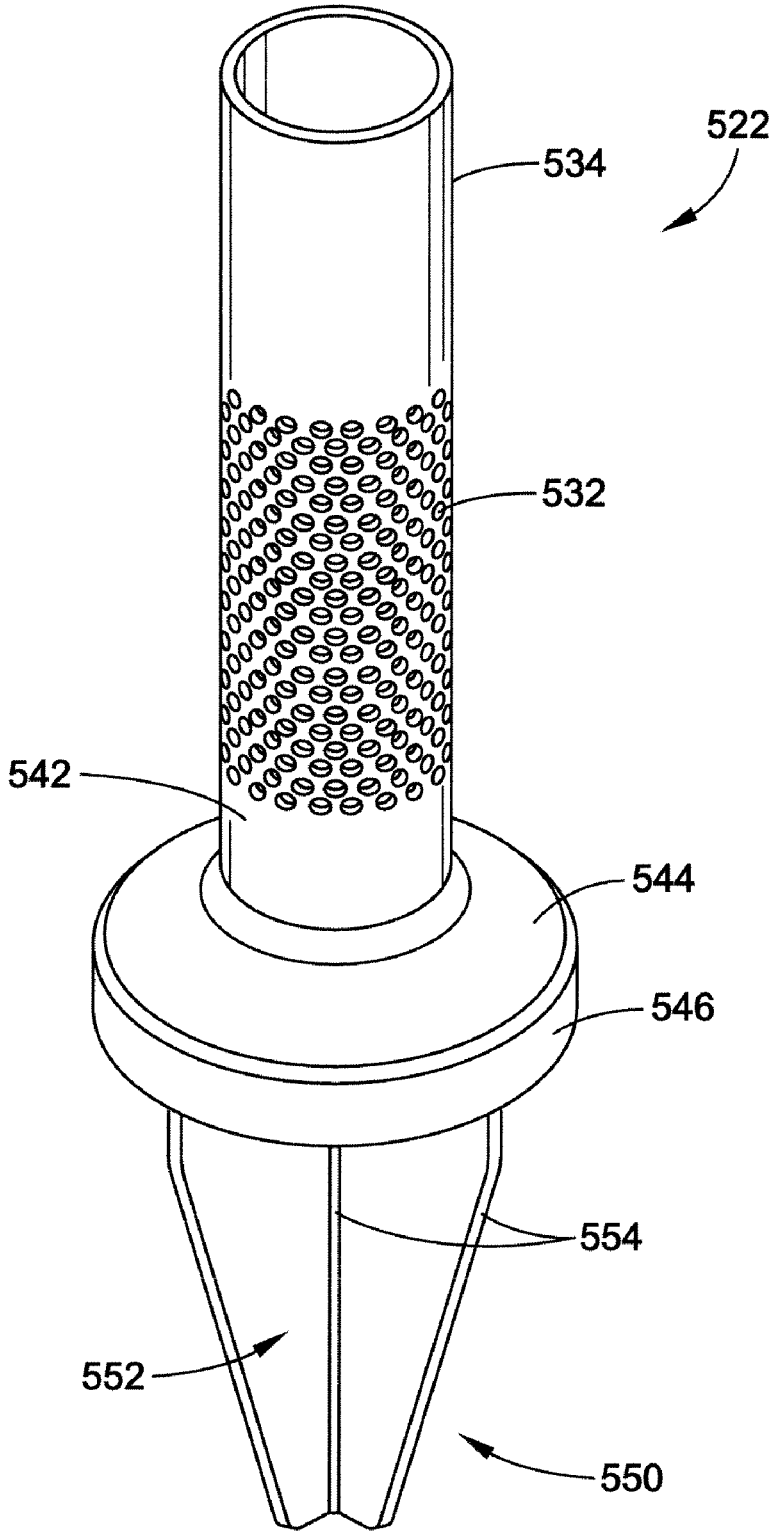
FIG. 17 is an enlarged perspective view of a perforated tube of the dirt cup of FIG. 15.

Each perforated tube 522 extends longitudinally in each cyclonic airflow chambers 508, 510 and includes a plurality of small holes 532 disposed in a side wall of the tube. Each perforated tube has an upper end 534 in fluid communication with an inlet section 536 of an air manifold 540 and a closed lower end 542. As shown in FIG. 17, the closed lower end of each tube 522 includes an outwardly flared section 544 which retards an upward flow of dust that has fallen below the lower end 542. A flange or skirt 546 extends longitudinally from the flared section, which also blocks rising dust from reentering the separator cone 520, thereby further improving the filtering of the dust entrained airstream.

Extending from the closed lower end 542 of each tube 522 is a laminar flow member 550. Each laminar flow member can include a cross blade assembly 552, which can be formed of two flat blade pieces 554 that are oriented approximately perpendicular to each other. It should be appreciated that the cross blade 552 is not limited to the configuration shown in FIG. 17 but may be formed of various shapes such as a rectangular shape, a triangular shape or an elliptical shape, when viewed from its side. Also, in addition to a cross blade design, other designs are also contemplated. Such designs can include blades that are oriented at angles other than normal to each other or that use more than two sets of blades.

With reference again to FIGS. 15 and 16, the air manifold 540 includes the inlet section 536 through which dirty air passes and an outlet section 560. The inlet section, which is in fluid communication with the nozzle main suction opening, directs a flow of the dirty airstream into two separate dirty air outlets 562 leading to a respective one of the first and second airflow chambers 508, 510. Dirt entrained air flows into the inlet section 536, into the two separate dirty air outlets 562 and thus into the first and second airflow chambers defined within the dirt container 500. The airflow into the airflow chambers 508, 510 is tangential which causes a vortex-type, cyclonic or swirling flow. Such vortex flow is directed downwardly in the airflow chamber since the top end thereof is blocked by the flange 526 of the separator cone 520.

Figure 18:
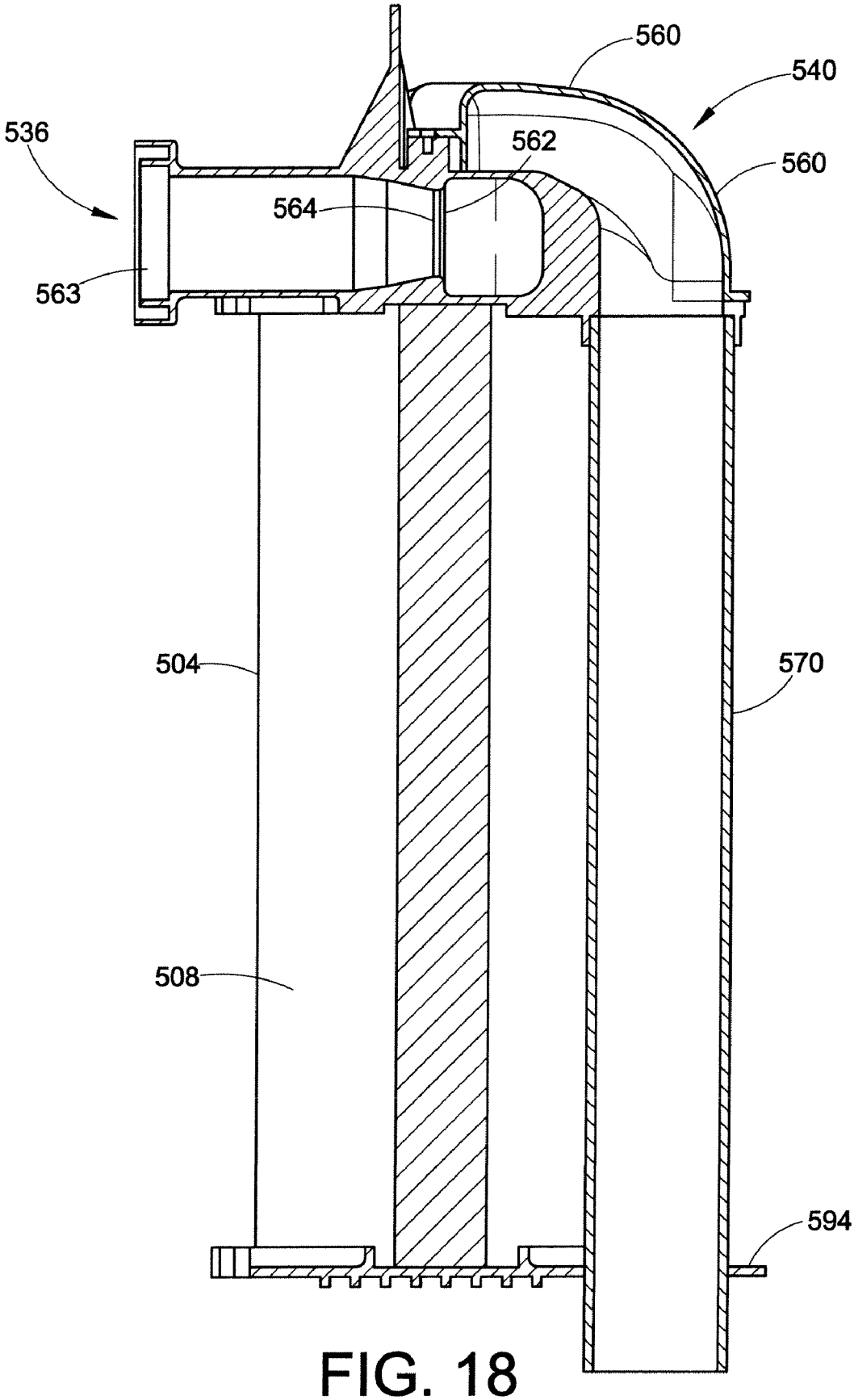
FIG. 18 is a left side elevational view in cross-section of the dirt cup of FIG. 15.
Figure 19:
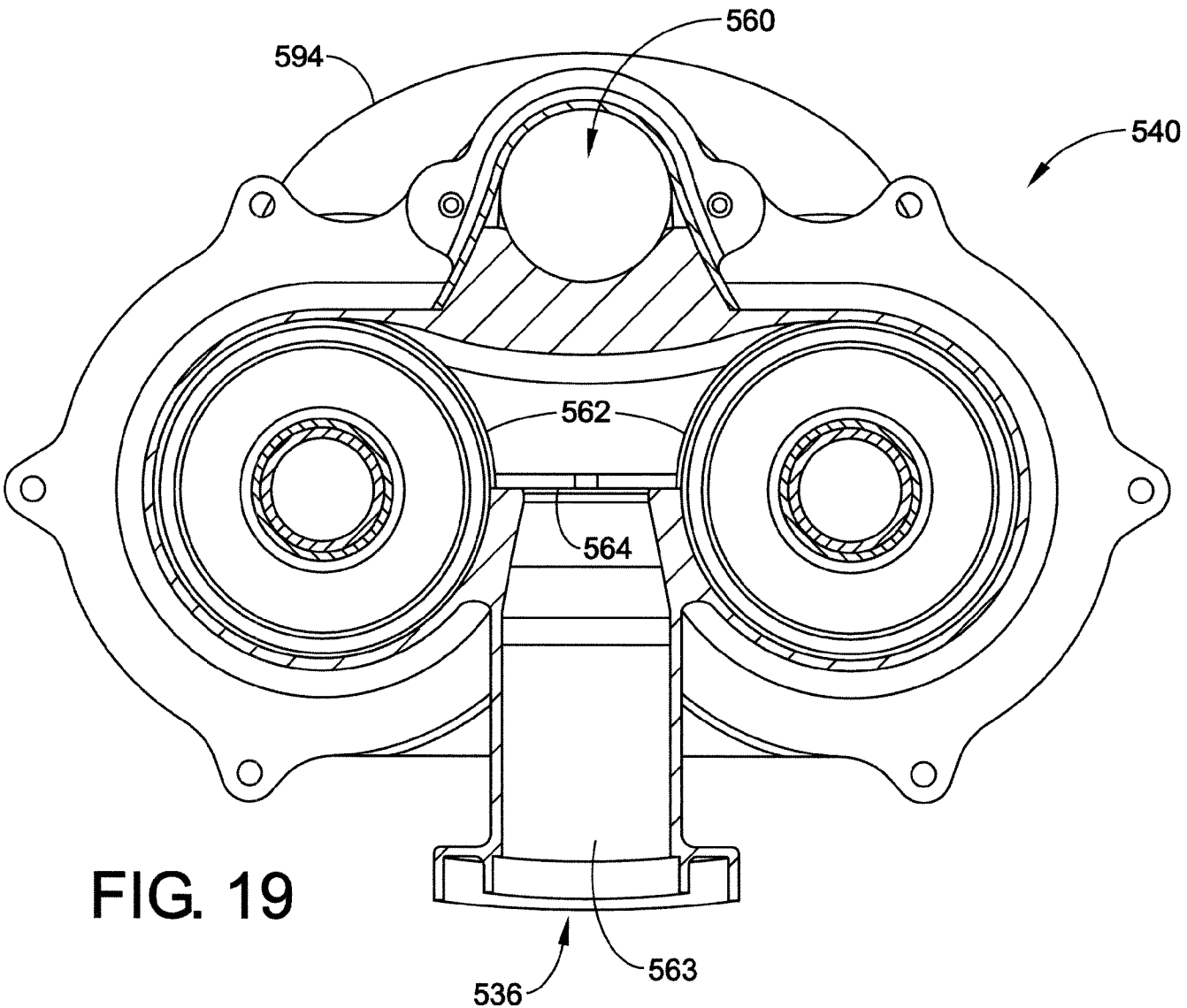
FIG. 19 is a top cross-sectional view of the dirt cup of FIG. 15 illustrating an air manifold thereof.

With reference now to FIGS. 18 and 19, the inlet section 536 includes an inlet 563 having a first diameter and an outlet 564 having a second, smaller, diameter. This arrangement allows the airstream within the inlet section to be drawn into the airflow chambers by way of the venturi effect, which increases the velocity of the airstream. It should be appreciated that because the inlet 563 has a greater diameter than the outlet 564, the venturi effect created within the inlet section 536 creates an increased vacuum in the inlet section. Also, the outlet section is inclined at an acute angle to the direction of the inlet section at the point at which the outlet 564 opens into the dirty air outlets 562 and the interior of the airflow chambers 508, 510. It will also be appreciated that the venturi could be formed by narrowing the passageway in the inlet section 536 in some other way, for example by forming the sides of the passageway with inwardly curved opposing sides to form a narrowing in the inlet section.

Figure 20:
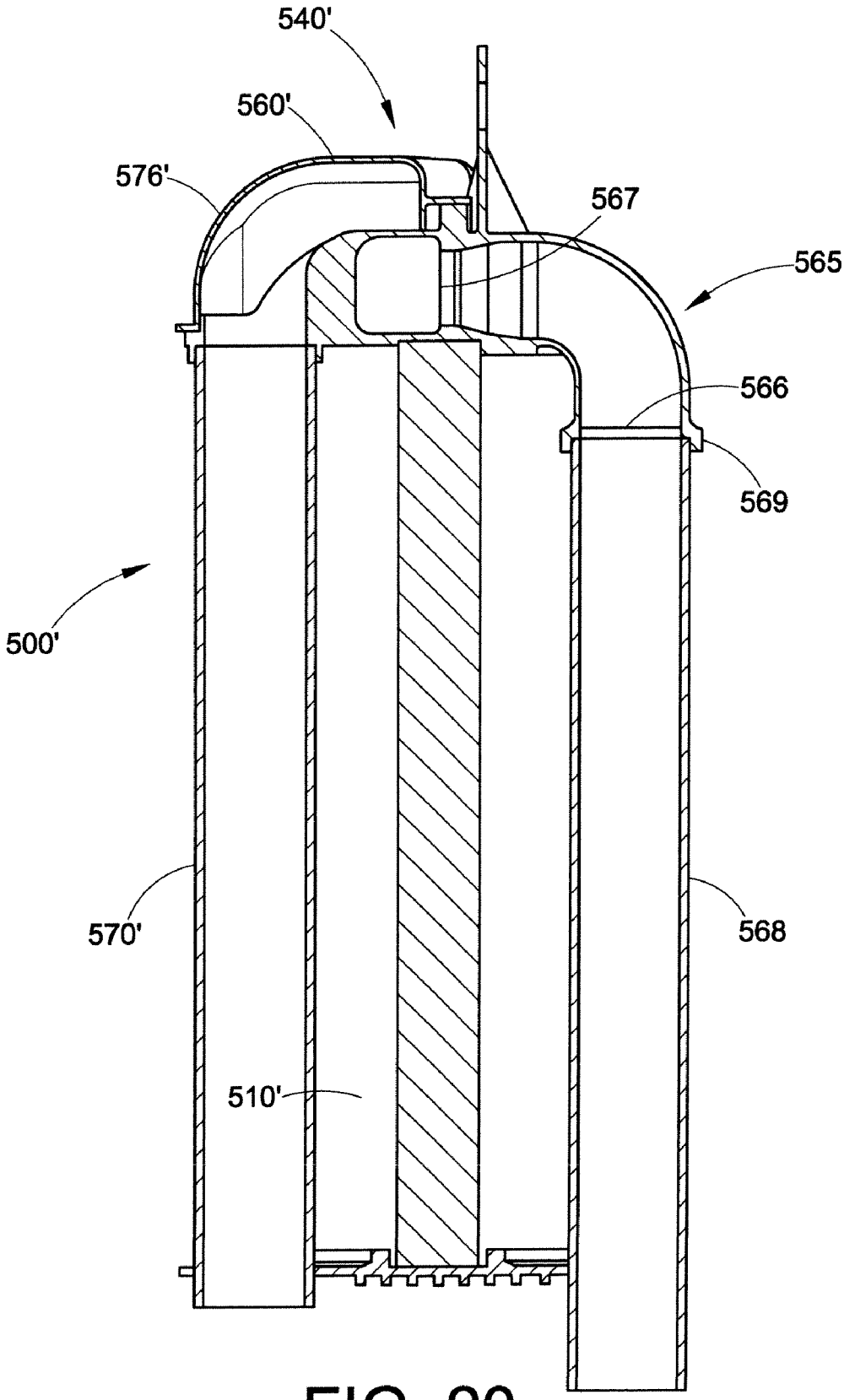
FIG. 20 is a right side elevational view in cross-section of the dirt cup of FIG. 15 showing an alternative embodiment of an inlet section of an air manifold.
Figure 21:
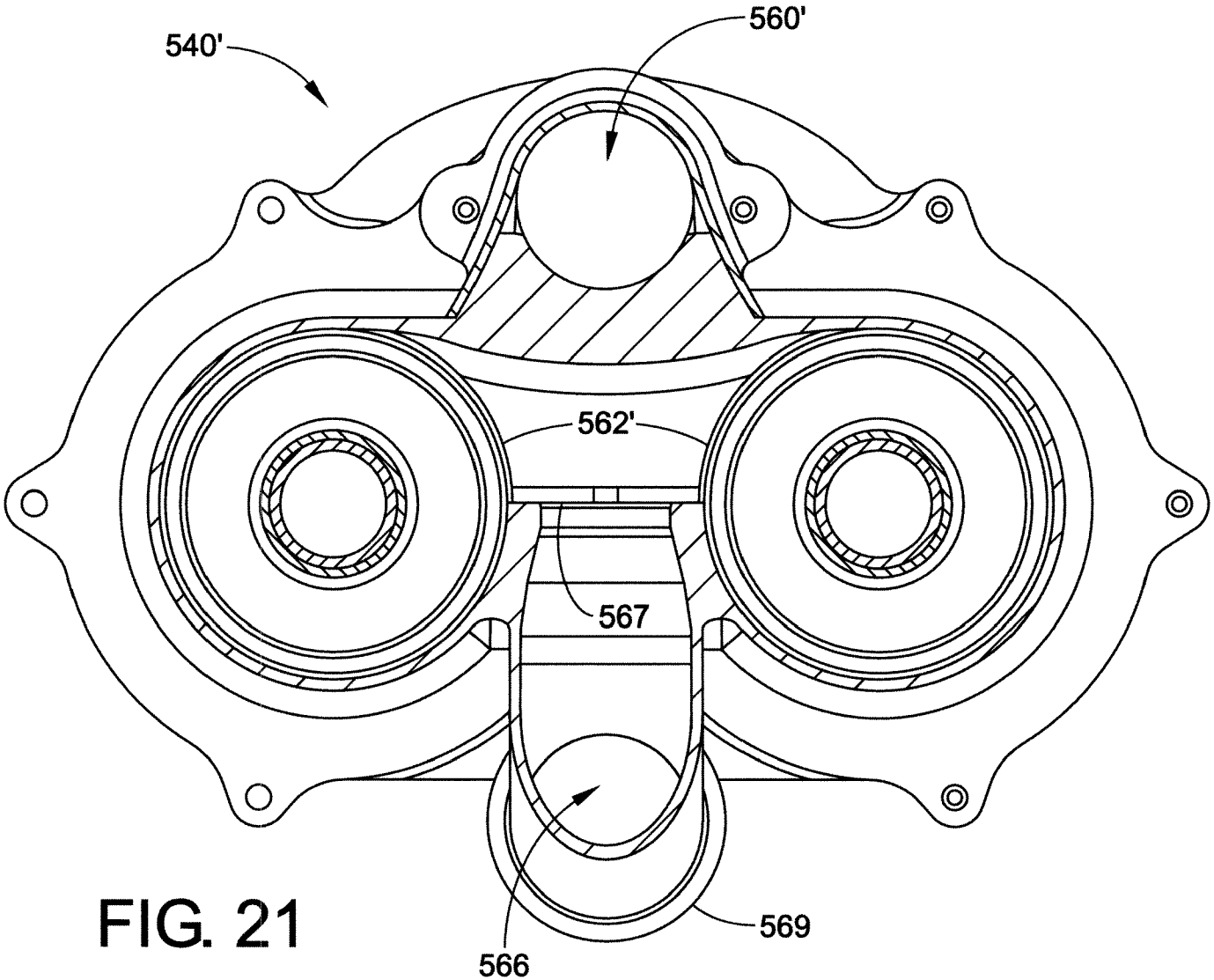
FIG. 21 is a top cross-sectional view of the dirt cup of FIG. 20 illustrating the air manifold thereof.

Similar to the aforementioned embodiment of the inlet section 536, an alternative embodiment is shown in FIGS. 20-21. Since most of the structure and function is substantially identical, reference numerals with a primed suffix (') refer to like components (e.g., air manifold 540 is referred to by reference numeral 540'), and new numerals identify new components in the additional embodiment.

As illustrated in FIGS. 20 and 21, an inlet section 565 of the air manifold 540' has a generally arcuate/shoulder configuration and includes an inlet 566 having a first diameter and an outlet 567 having a second, smaller, diameter. This arrangement also allows the airstream within the inlet section to be drawn into the airflow chambers by way of the venturi effect, which increases the velocity of the airstream. The inlet section 565 can be secured to a suction airstream conduit 568 by a flange 569 extending from the inlet end 566. The suction airstream conduit 568 is in fluid communication with the main suction opening of the nozzle base and has a longitudinal axis which is oriented generally parallel to the longitudinal axes of the airflow chambers defined within the dirt container 500'.

With reference again to FIGS. 15 and 16, as the dirt entrained air enters the airflow chambers 508, 510, the air and the dirt cyclonically rotate along an inner wall of the separator cone 520. The dirt and debris is removed from the air flow, via gravity, and collects at a bottom portion of the chambers. However, relatively light fine dust is less subject to a centrifugal force. Accordingly, the fine dust may be contained in the airflow circulating near the bottom portion of the airflow chambers 508, 510. Since the cross blade 552 extends into the bottom portion of the airflow chambers, the circulating airflow hits the blade pieces 554 of the cross blade 552. When the circulating airflow contacts the laminar flow member, further rotation is stopped thereby forming a laminar flow. As a result, the dirt entrained in the air is allowed to drop out, via gravity. Also, dust is prevented from being re-entrained in the airflow by the laminar flow member 550. The fine dust in the airflow drops out of the airstream and falls by gravity in each of the airflow chambers 508, 510. Such fine dust is collected at the bottom portion of the chambers.

The cleaned and now laminar axial flow of air then makes a 900 turn and becomes a radial flow, as mandated by the presence of the skirt 546. This change in air flow direction will cause even more dirt to fall out of the airflow. Then, the air flows again axially up the flange 546 until it is again allowed to flow radially inwardly once it clears the outwardly flared section 544 at the lower end of each tube. The cleaned air is then discharged out through the holes 532 of the perforated tube 522 and the outlet section 560. The outlet section 560 collects a flow of cleaned air from both of the airflow chambers and merges the flow of cleaned air into the single cleaned air outlet passage 570.

As shown in FIG. 16, the outlet section includes a pair of cleaned air inlets 572 communicating with a respective one of the first and second centrifugal chambers 508, 510. Each inlet is in fluid communication with a pair of cleaned air conduits 574. A first end of each cleaned air conduit 574 is secured to the upper end 534 of each perforated tube 522. As shown in FIG. 15, a second end of each cleaned air conduit 574 merges into a single outlet end 576 that is in fluid communication with an inlet of the outlet passage 570.

With continuing reference to FIGS. 15 and 16, to secure the air manifold 540 to the dirt container 500, a lower portion 580 of the air manifold includes a first channel 582 which is dimensioned to receive at least an upper peripheral end 584 of each cylindrical section 504 and 506, thereby creating a seal between the air manifold and the dirt container. The lower portion also includes a second channel 586 which is dimensioned to receive a radial rim 588 extending from the larger diameter end of the separator cone 520.

Similar to the first channel 582 of the air manifold, a bottom plate 594 includes a channel 596 dimensioned to receive at least a lower peripheral end 598 of each cylindrical sections 504 and 506, thereby creating a seal between the bottom plate and the dirt container 500.

The present disclosure has been described with reference to several preferred embodiments. Obviously, modifications and alterations will occur to others upon reading and understanding the preceding detailed description. It is intended that the embodiments be construed as including all such modifications and alterations insofar as they come within the scope of the appended claims or the equivalents thereof.

What is claimed is:

1. A vacuum cleaner comprising:
- a housing; and
- a dirt container selectively mounted to said housing, said dirt container including:
  - a side wall,
  - a separator cone mounted to said side wall,
  - a perforated tube extending longitudinally in said separator cone,
  - a cyclonic flow chamber defined between said separator cone and said perforated tube,
  - a dirt storage area located beneath said separator cone, and
  - an air manifold comprising a top wall of said dirt container, said separator cone and said perforated tube communicating with said air manifold.

2. The vacuum cleaner of claim 1, wherein said dirt container further comprises a bottom wall.

3. The vacuum cleaner of claim 2, wherein said bottom wall comprises a selectively openable lid to allow an emptying of said dirt container.

4. The vacuum cleaner of claim 1 further comprising a cleaned air outlet tube communicating with said air manifold, said cleaned air outlet tube extending parallel to a longitudinal axis of said dirt container.

5. The vacuum cleaner of claim 1, wherein said air manifold includes an air inlet passage leading to said separator cone, said air inlet passage having a first end of a first diameter and a second end of a second, smaller, diameter allowing an airstream to be drawn into said separator cone by way of the venturi effect, to increase a velocity of the airstream entering said separator cone.

* * * * *